US008342067B2

(12) United States Patent
Kato et al.

(10) Patent No.: US 8,342,067 B2
(45) Date of Patent: Jan. 1, 2013

(54) PUNCHING APPARATUS

(75) Inventors: Hitoshi Kato, Toride (JP); Naoki Ishikawa, Kashiwa (JP); Yasuo Fukatsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 12/569,697

(22) Filed: Sep. 29, 2009

(65) Prior Publication Data

US 2010/0077893 A1 Apr. 1, 2010

(30) Foreign Application Priority Data

Sep. 30, 2008 (JP) ..... 2008-254002

(51) Int. Cl.
*B26D 5/06* (2006.01)

(52) U.S. Cl. ..... 83/74; 83/628; 83/691; 83/686

(58) Field of Classification Search ..... 83/74, 686, 83/549, 687, 200, 628, 620, 618, 927, 691; 234/97, 96, 98, 42–43, 94, 101, 100; 29/34 R
See application file for complete search history.

(56) References Cited

U.S. PATENT DOCUMENTS

| | | | | |
|---|---|---|---|---|
| 6,305,262 | B1 * | 10/2001 | Watanabe | 83/670 |
| 6,783,124 | B2 * | 8/2004 | Tamura et al. | 270/58.07 |
| 7,073,706 | B2 | 7/2006 | Yaginuma | |
| 7,172,185 | B2 | 2/2007 | Hattori | |
| 7,823,494 | B2 * | 11/2010 | Baba | 83/628 |
| 2001/0049990 | A1 * | 12/2001 | Takaishi et al. | 83/628 |
| 2005/0103179 | A1 * | 5/2005 | Mori et al. | 83/669 |
| 2005/0132903 | A1 * | 6/2005 | Nagae | 100/280 |
| 2007/0107577 | A1 * | 5/2007 | Hattori et al. | 83/687 |
| 2009/0229435 | A1 * | 9/2009 | Iguchi et al. | 83/109 |
| 2011/0011233 | A1 * | 1/2011 | Baba | 83/628 |

* cited by examiner

*Primary Examiner* — Ghassem Alie
(74) *Attorney, Agent, or Firm* — Canon USA, Inc., IP Division

(57) ABSTRACT

A punching apparatus includes a punch for punching holes in a sheet, a cam member for reciprocally moving the punch in a punching direction, a motor for moving the cam member, a pulse generator for generating pulses that are synchronized with the driving of the motor, and a control unit for applying a brake to the motor to stop the cam member upon counting the pulses of a predetermined number from the pulse generator after the cam member moved by the driving of the motor passes through a reference position.

8 Claims, 17 Drawing Sheets

105
68A
68B
68C
68D
68E
50
58
67
57
56
94
91
61
92
93
72
66
S
51
62
64
61
63
60
52
103
102
101
75
70C
73C
70E
73E
70B
78E
79E
70D
73B
(73D)
70A
63
73A
67
64

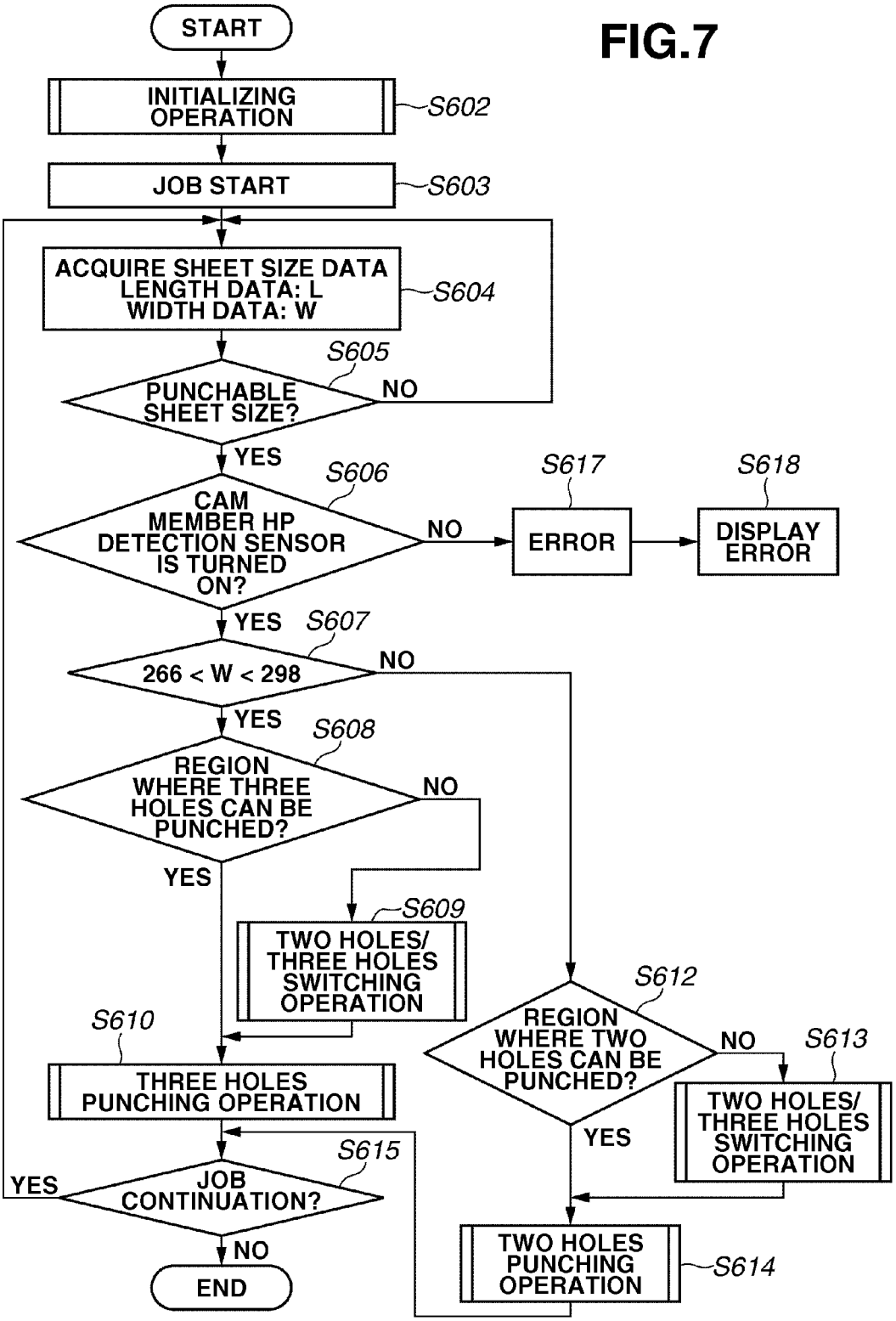
FIG.7
START
INITIALIZING OPERATION
S602
JOB START
S603
ACQUIRE SHEET SIZE DATA
LENGTH DATA: L
WIDTH DATA: W
S604
S605
PUNCHABLE SHEET SIZE?
NO
YES
S606
CAM MEMBER HP DETECTION SENSOR IS TURNED ON?
NO
S617
ERROR
S618
DISPLAY ERROR
YES
S607
266 < W < 298
NO
YES
S608
REGION WHERE THREE HOLES CAN BE PUNCHED?
NO
YES
S609
TWO HOLES/ THREE HOLES SWITCHING OPERATION
S612
REGION WHERE TWO HOLES CAN BE PUNCHED?
NO
S613
TWO HOLES/ THREE HOLES SWITCHING OPERATION
YES
S610
THREE HOLES PUNCHING OPERATION
S615
JOB CONTINUATION?
YES
NO
END
TWO HOLES PUNCHING OPERATION
S614

FIG.9

| | | CAM MEMBER REGION DETECTION SENSOR | | | |
|---|---|---|---|---|---|
| | | OFF | | ON | |
| CAM MEMBER MOVEMENT DIRECTION DETECTION SENSOR | OFF | MOVE TO STOP REGION D | | MOVE TO STOP REGION D | |
| | ON | CAM MEMBER HP SENSOR | | CAM MEMBER HP SENSOR | |
| | | OFF | ON | OFF | ON |
| | | MOVE TO STOP REGION A | MOVE TO STOP REGION G | MOVE TO STOP REGION G | MOVE TO STOP REGION G |

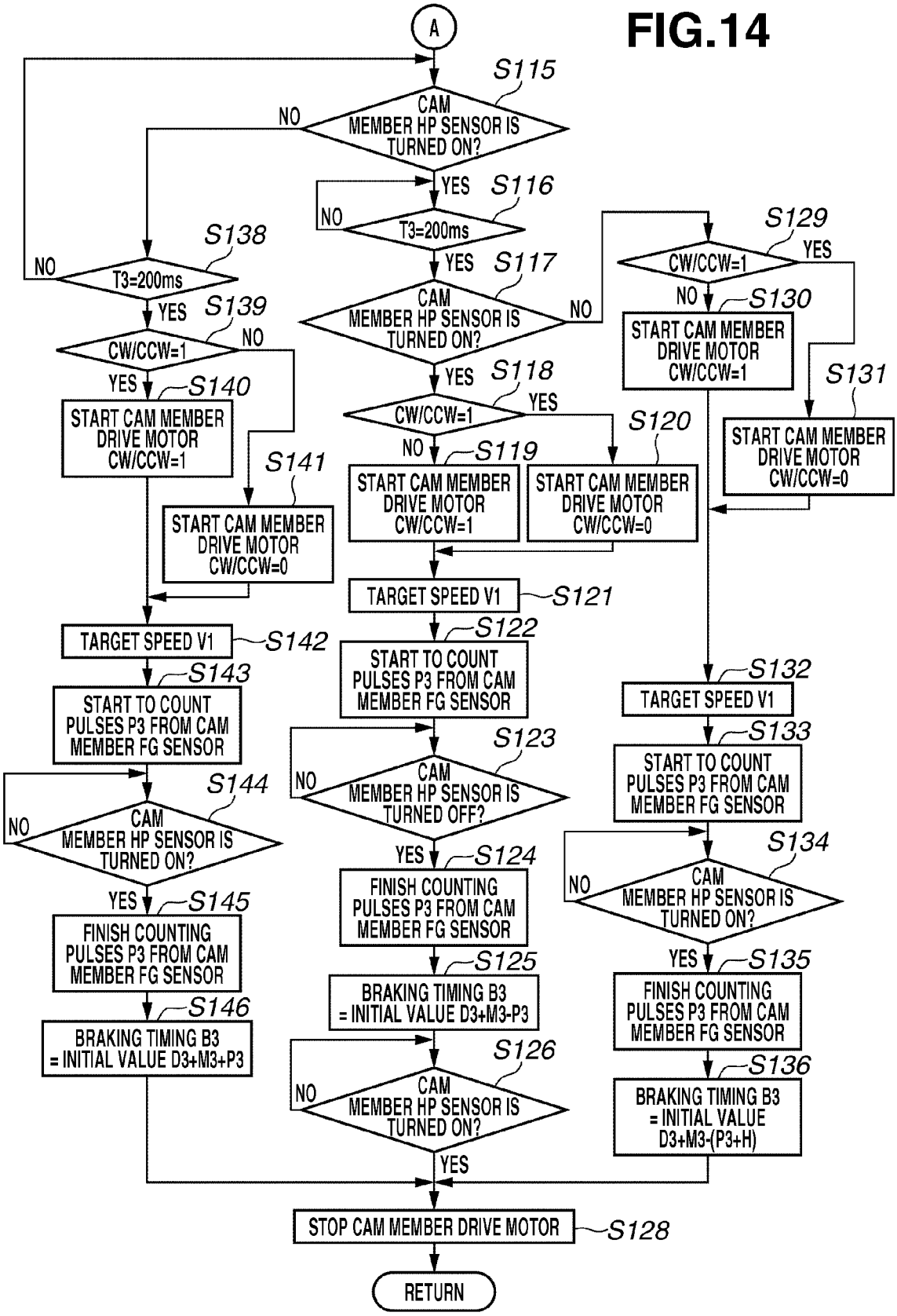
FIG.14
A
S115
CAM MEMBER HP SENSOR IS TURNED ON?
NO
YES
S116
T3=200ms
NO
YES
S117
CAM MEMBER HP SENSOR IS TURNED ON?
NO
YES
S118
CW/CCW=1
YES
NO
S119
START CAM MEMBER DRIVE MOTOR CW/CCW=1
S120
START CAM MEMBER DRIVE MOTOR CW/CCW=0
TARGET SPEED V1
S121
S122
START TO COUNT PULSES P3 FROM CAM MEMBER FG SENSOR
S123
CAM MEMBER HP SENSOR IS TURNED OFF?
NO
YES
S124
FINISH COUNTING PULSES P3 FROM CAM MEMBER FG SENSOR
S125
BRAKING TIMING B3 = INITIAL VALUE D3+M3-P3
S126
CAM MEMBER HP SENSOR IS TURNED ON?
NO
YES
S129
CW/CCW=1
YES
NO
S130
START CAM MEMBER DRIVE MOTOR CW/CCW=1
S131
START CAM MEMBER DRIVE MOTOR CW/CCW=0
S132
TARGET SPEED V1
S133
START TO COUNT PULSES P3 FROM CAM MEMBER FG SENSOR
S134
CAM MEMBER HP SENSOR IS TURNED ON?
NO
YES
S135
FINISH COUNTING PULSES P3 FROM CAM MEMBER FG SENSOR
S136
BRAKING TIMING B3 = INITIAL VALUE D3+M3-(P3+H)
S138
T3=200ms
NO
YES
S139
CW/CCW=1
YES
NO
S140
START CAM MEMBER DRIVE MOTOR CW/CCW=1
S141
START CAM MEMBER DRIVE MOTOR CW/CCW=0
TARGET SPEED V1
S142
S143
START TO COUNT PULSES P3 FROM CAM MEMBER FG SENSOR
S144
CAM MEMBER HP SENSOR IS TURNED ON?
NO
YES
S145
FINISH COUNTING PULSES P3 FROM CAM MEMBER FG SENSOR
S146
BRAKING TIMING B3 = INITIAL VALUE D3+M3+P3
STOP CAM MEMBER DRIVE MOTOR
S128
RETURN

PUNCHING APPARATUS

BACKGROUND OF THE INVENTION

1. Field of the Invention

The present invention relates to a punching apparatus for punching holes in a sheet and, in particular, to stop position control of a cam member operated by a motor.

2. Description of the Related Art

Conventionally, a punching apparatus is incorporated in a sheet processing apparatus for punching holes in a sheet discharged from an image forming apparatus. In a punching apparatus discussed in U.S. Pat. No. 7,073,706, a motor moves a cam member for moving a punch up and down, and the punch is inserted into a die hole, to punch holes in a sheet.

Regions where the cam member is positioned include a punching region where the cam member is positioned when the punch is inserted into the die hole and a stop region where the cam member is positioned when the punch is not inserted into the die hole. When the cam member is in the punching region, the punch blocks a paper path, so that the sheet cannot be conveyed. In order to convey the subsequent sheet to the punching apparatus, therefore, the cam member must be moved and reliably stopped in the stop region after holes are punched in the sheet.

On the other hand, as the motor for driving the cam member, a DC motor is used to cope with to an unexpected large torque generated when the holes are punched in the sheet. However, the DC motor may not be immediately stopped because of the inertia even when a brake is applied and may overrun a target stop position by a predetermined amount. The faster the rotational speed of the motor at the time of punching, the stronger an inertial force, and the larger an amount of overrun becomes. In the conventional punching apparatus, therefore, the cam member can be stopped in the stop region by applying the brake to the motor before entering the stop region.

On the other hand, an amount of movement of the cam member by the overrun varies for each punching apparatus depending on a variation in a braking force of the motor and a variation in a frictional force of a driving structure. When the brake is applied to the motor before the cam member enters the stop region, the cam member may not be able to reach the stop region if the amount of overrun is too small. On the other hand, the cam member may be stopped in the punching region without being stopped in the stop region if the amount of overrun is too large.

In order to prevent such inconvenience, in U.S. Pat. No. 7,172,185, a sensor for measuring an amount of rotation of a motor is used to measure an amount of overrun after an elapse of a predetermined period of time since the brake was applied to the motor, to confirm overrun. Braking timing of the motor is controlled based on the measured amount of overrun so that a stop position of a punching edge is placed within a predetermined range.

In the conventional method which measures an amount of rotation in a period of time elapsed since the brake was applied to a motor until the motor is stopped using the sensor, when a position where the motor is stopped is in the vicinity of a boundary of a detection range (a detection edge) of the sensor, an amount of overrun may, in some cases, be erroneously detected by the vibration during the stop of the motor. More specifically, a detection member that moves along with a cam member comes and goes on the detection edge of the sensor so that an output of the sensor changes. Therefore, it may be erroneously detected that the cam member moves, though it is already stopped. When the amount of overrun is erroneously detected, the braking timing cannot be satisfactorily controlled. Thus, the motor is stopped with the punching edge projecting onto a paper path, resulting in jams. When a plurality of sensors is used such that the rotational direction of the motor can be detected to prevent the erroneous detection, by adding the sensors, the punching apparatus increases in cost and size and a detection circuit becomes complicated. When the braking timing is set to a fixed value, a high-cost motor that hardly varies in an amount of overrun must be used.

It is also possible that when the brake is applied to the motor, a movement region of the cam member is configured to be mechanically limited such that the cam member does not overrun. However, a shock occurring at the time when the cam member has reached a limit region results in the reduction in the life of the motor.

SUMMARY OF THE INVENTION

The present invention is directed to a punching apparatus that has solved the above-mentioned problems.

The present invention is also directed to a punching apparatus configured to reliably stop a cam member for reciprocally moving a punching edge in a stop region in a small-sized and low-cost configuration.

The present invention is also directed to a punching apparatus capable of accurately adjusting braking timing of a motor for driving a cam member for reciprocally moving a punching edge.

According to an aspect of the present invention, a punching apparatus includes a punch configured to punch holes in a sheet, a cam member configured to reciprocally move the punch in a punching direction, a motor configured to move the cam member, a position detection unit configured to detect the position of the cam member, a pulse generator configured to generate pulses that are synchronized with the driving of the motor, and a control unit configured to adjust a stop position of the cam member moved by the driving of the motor, in which the control unit performs first driving processing for stopping the driving of the motor upon counting the pulses of a predetermined number after the position detection unit detects that the moved cam member has passed through a reference position, drives the motor again such that the movement direction of the cam member is reversed when the position detection unit detects that the cam member is stopped within a predetermined region in the first driving processing, performs second driving processing for counting the pulses in a period of time elapsed since the motor was driven again until the position detection unit detects that the cam member has passed through the predetermined region, and changes the predetermined number based on the pulses counted in the second driving processing, to determine when to stop the driving of the motor when the holes are punched in the sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 7 is a flowchart illustrating the operation of a punching apparatus.

FIG. 9 is a diagram illustrating a movement destination of a cam member during an initializing operation of a punching apparatus.

FIG. 14 is a flowchart illustrating an operation for braking timing adjustment in a three-hole region of a punching apparatus.

DESCRIPTION OF THE EMBODIMENTS

Various exemplary embodiments, features, and aspects of the invention will be described in detail below with reference to the drawings.

A copying machine, which is an example of an image forming apparatus, loaded with a punching apparatus according to an exemplary embodiment of the present invention will be described with reference to FIG. 1.

Figure 1:
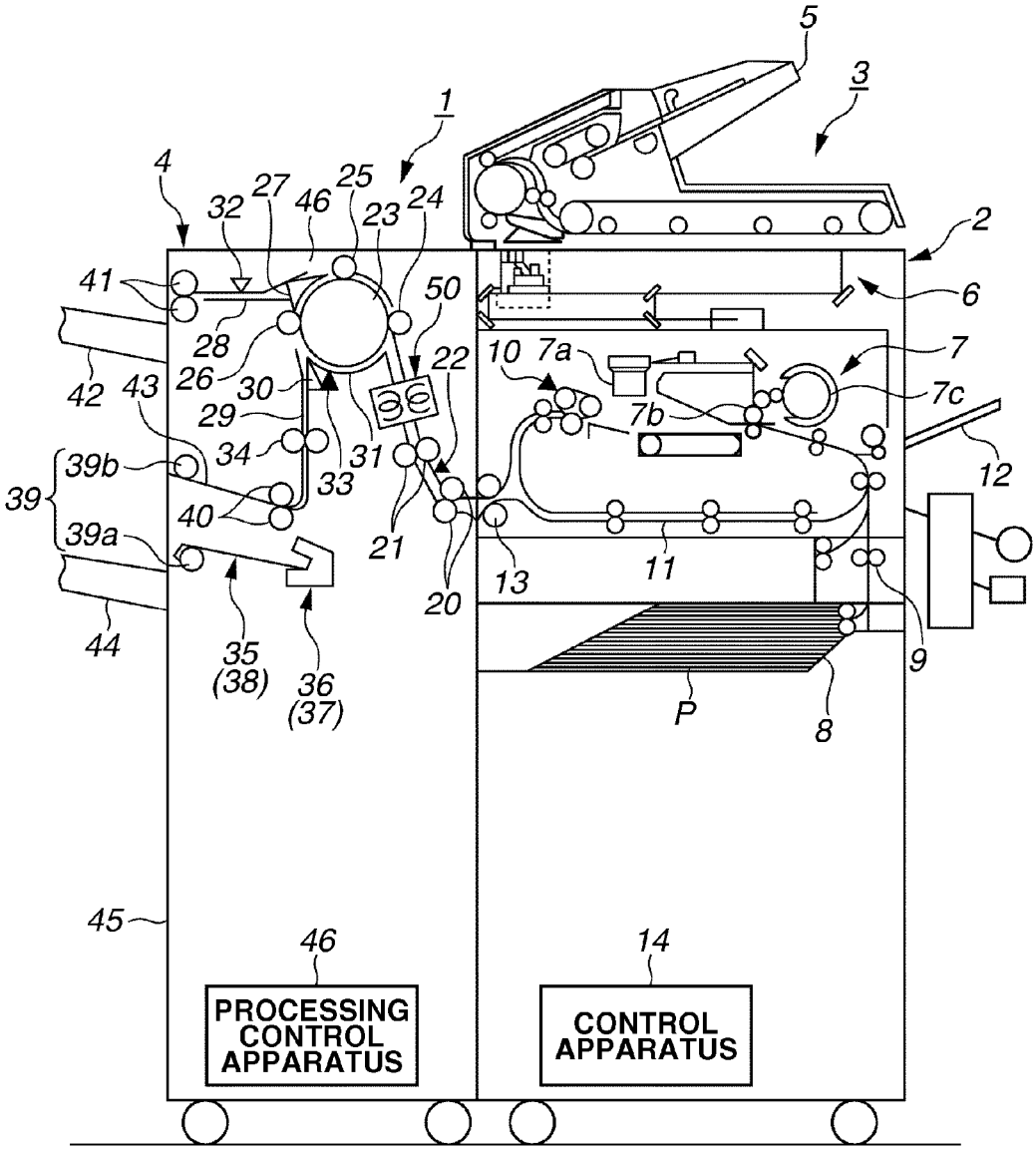
FIG. 1 is a schematic front sectional view of a copying machine, which is an image forming apparatus, including a sheet processing apparatus according to an exemplary embodiment of the present invention.

In FIG. 1, a copying machine 3 has a sheet processing apparatus 1 connected to its copying machine main body 2. The sheet processing apparatus 1 includes a punching apparatus 50 for punching holes in a sheet P on which an image has been formed in the copying machine main body 2, and a finisher 4, capable of post-processing sheets P, for binding the sheets P for each set.

The copying machine 3 photoelectrically reads a document automatically fed from a document feeding apparatus 5 provided in its upper part using an optical unit 6, and transmits information relating to the document as a digital signal to an image forming apparatus 7. A light irradiation unit 7*a* irradiates a photosensitive drum 7*b* with a laser beam based on the received digital signal, to form a latent image. A developing unit 7*c* develops the latent image into a toner image.

On the other hand, a plurality of sheet cassettes 8 accommodating sheets P of various sizes is provided in a lower part of the copying machine main body 2. A toner image is transferred on the sheet P conveyed by a conveyance roller pair 9 from the sheet cassette 8 using an electrophotographic process in the image forming unit 7. The sheet P is conveyed to a fixing device 10. The toner image is fixed to the sheet P by heat and pressure in the fixing device 10.

In a mode in which an image is formed on one surface of the sheet P, the sheet P having the image formed thereon is conveyed to the sheet processing apparatus 1. On the other hand, when images are formed on both surfaces of the sheet P, the sheet P having the image formed on its one surface is conveyed to a re-conveyance path 11 using a switch back process, and is conveyed to the image forming unit 7 again, where the image is formed on the other surface of the sheet P. Thereafter, the sheet P is fed into the sheet processing apparatus 1. The sheet P can be also supplied from a manual feed tray 12. Furthermore, the operation of each of the units within the copying machine main body 2 is controlled by a control apparatus 14.

In FIG. 1, an input roller pair 20 in the sheet processing apparatus 1 receives the sheet P discharged from a discharge roller pair 13 in the image forming apparatus 3. A first conveyance roller pair 21 conveys the received sheet P. A sheet detection sensor 22 detects the passage of the sheet P.

Thereafter, the punching apparatus 50 punches holes in the vicinity of a trailing edge of the sheet P. The sheet P in which the holes have been punched is wound around a roll surface of a buffer roller 23, and is pressed thereagainst by pressing rollers 24, 25, and 26. More specifically, the sheet P is temporarily retained in the buffer roller 23.

A first diverter 27 selectively switches a non-sort path 28 and a sort path 29. A second diverter 30 switches the sort path 29 and a buffer path 31 temporarily retaining the sheet P.

A sensor 32 detects the sheet P in the non-sort path 28. A sensor 33 detects the sheet P in the buffer path 31. A second conveyance roller pair 34 conveys the sheet P in the sort path 29.

A processing tray unit 35 temporarily accumulates the sheets P, and aligns a sheet bundle in a conveyance direction and a direction perpendicular to the conveyance direction. Furthermore, the processing tray unit 35 includes an intermediate tray 38 provided for carrying out a stapling process by a stapler 37 in a stapling unit 36. A lower discharge roller 39*a*, which is one of discharge rollers composing a stack discharge roller pair 39, is arranged at a discharge end of the intermediate tray 38. The lower discharge roller 39*a* is fixed to the intermediate tray 38.

A first discharge roller pair 40 arranged at an outlet of the sort path 29 discharges the sheet P onto the intermediate tray 38. A second discharge roller pair 41 arranged at an outlet of the non-sort path 28 may discharge the sheet P which is not post-processed, onto a sample tray 42.

An upper discharge roller 39*b*, which is one of the stack discharge roller pair 39, is supported on a swing guide 43. When the swing guide 43 swings to a closed position, the upper discharge roller 39*b* abuts on the lower discharge roller 39*a* under pressure to discharge the sheet P on the intermediate tray 38 onto a stack tray 44. A bundle stacking guide 45 accepts a trailing edge of the sheet bundle (a rear edge in a bundle discharge direction) stacked on the stack tray 44 and the sample tray 42. The bundle stacking guide 45 is also used as the exterior of the sheet processing apparatus 1. A processing control apparatus 46 controls the operation of each of the units in the sheet processing apparatus 1.

Figures 2A, 2B, 2C:
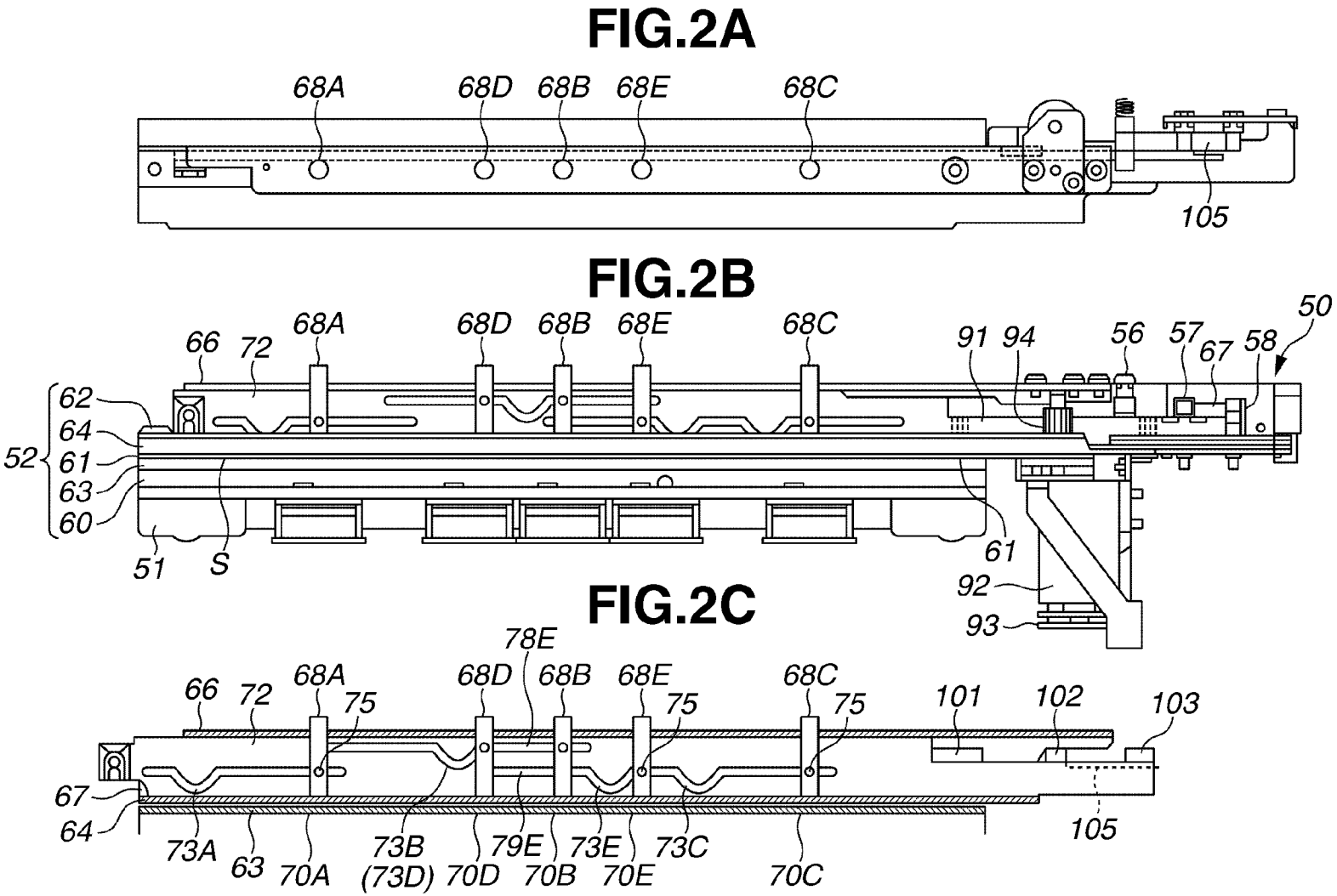
FIGS. 2A, 2B, and 2C are diagrams illustrating the configuration of a punching apparatus.
Figure 3:
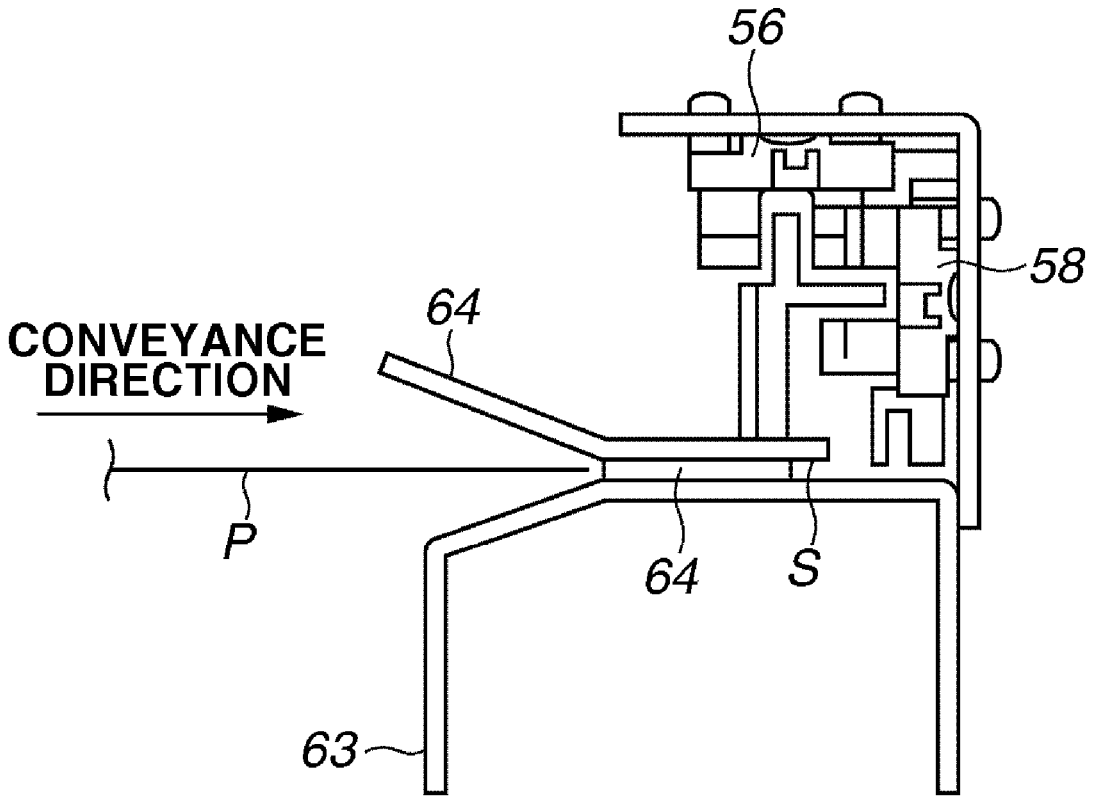
FIG. 3 is a diagram illustrating a punching apparatus as viewed from the right side.

The configuration of the punching apparatus 50 loaded in the finisher 4 will be then described with reference to FIG. 2. FIG. 2A is a diagram illustrating the punching apparatus 50 illustrated in FIG. 1, showing a sheet conveyance surface from the top (from the right in FIG. 1). FIG. 2B is a diagram illustrating the punching apparatus 50 as viewed from the upstream side in a sheet conveyance direction. FIG. 2C is a cross sectional view along a cam member 72. FIG. 3 is a cross sectional view of the punching apparatus 50 in the sheet conveyance direction. The punching apparatus 50 illustrated in FIG. 2 can selectively punch two holes and three holes in the sheet P.

The punching apparatus 50 includes a frame 51 and a frame 52 that can move in a horizontal direction in FIG. 2 on the frame 51. The frame 52 includes a lower frame 60 moving on the frame 51 and an upper frame 62 fixed to the top of the lower frame 60 with a plurality of spacers 61 sandwiched therebetween. The spacer 61 is interposed between the lower frame 60 and the upper frame 62 for forming a space S through which the sheet P can pass between a top plate 63 of the lower frame 60 and a bottom plate 64 of the upper frame 62. The top plate 63 of the lower frame 60 and the bottom plate 64 of the upper frame 62 are spaced to gradually narrow the distance therebetween along the sheet conveyance direction, as illustrated in FIG. 3, to guide the sheet P to the space S.

The upper frame 62 assumes a bracket shape in cross section by the bottom plate 64 and a top plate 66 that face each other and a back plate 67 that connects the bottom plate 64 and the top plate 66 to each other. Five punches 68A, 68B, 68C, 68D, and 68E move up and down to penetrate the bottom plate 64 and the top plate 66. Die holes 70A, 70B, 70C, 70D, and 70E for punching holes in the sheet P in corporation with the punches 68A, 68B, 68C, 68D, and 68E are formed in the top plate 63 of the lower frame 60 that faces lower ends of the punches 68A, 68B, 68C, 68D, and 68E. Therefore, the top plate 63 of the lower frame 60 functions as a die hole and a sheet guiding plate.

The punches 68A, 68B, 68C, 68D, and 68E are classified into the three-holes-punching punches 68A, 68B, and 68C equally spaced in the upper frame 62 and the two-holes-punching punches 68D and 68E disposed among the three-holes-punching punches 68A, 68B, and 68C. Furthermore, engaging pins 75 that engage with cams 73A, 73B, 73C, 73D, and 73E in the cam member 72 are respectively attached to the punches 68A, 68B, 68C, 68D, and 68E at right angles.

The cams 73A, 73B, 73C, 73D, and 73E formed in the cam member 72 are classified into the three-holes-punching cams 73A, 73B, and 73C and the two-holes-punching cams 73D and 73E. Any one of the cams is in the shape of a groove having an inclined portion and a linear portion. The engaging pins 75 attached to the punches 68A, 68B, 68C, 68D, and 68E respectively engage with the cams 73A, 73B, 73C, 73D, and 73E. Therefore, positions in a reciprocating direction of the punches are determined depending on which portions of the cams 73A, 73B, 73C, 73D, and 73E the engaging pins 75 engage with. The cam member 72 moves in the horizontal direction of FIG. 2 so that each of the punches reciprocally moves in a punching direction.

In FIG. 2, the cam 73A is the three-holes-punching cam, with which the three-holes-punching punch 68A engages. The right linear portion of the cam 73A is made longer than the left linear portion thereof. The cam 73B (73D) functions as a three-holes-punching cam and a two-holes-punching cam. The three-holes-punching punch 68B at the center side of the three-holes-punching punches and the two-holes-punching punch 68D at the left side of the two-holes-punching punches engage with the cam 73B (73D). The cam 73B (73D) is shared between the two punches 68B and 68D. Therefore, it is possible to reduce the number of cams while narrowing the distance between the punches 68B and 68D. The two-holes-punching cam 73E and the three-holes-punching cam 73C respectively have linear portions communicating with each other. The two-holes-punching punch 68E at the right out of the two-holes-punching punches engages with the two-holes-punching cam 73E. The three-holes-punching punch 68C at the right side of the three-holes-punching punches engages with the three-holes-punching cam 73C. The respective outer linear portions of the two cams 73E and 73C extend in a direction away from each other.

The length of the right linear portion of the three-holes-punching cam 73A, the lengths of the right and left linear portions of the three-holes/two-holes-punching cam 73B (73D), the length of the left linear portion 79E of the two-holes-punching cam 73E, and the length of the right linear portion of the three-holes-punching cam 73C are set substantially equal. The three-holes-punching cam 73A, the two-holes-punching cam 73E, and the three-holes-punching cam 73C are at the same height, and the three-holes/two-holes-punching cam 73B (73D) is at a position higher in FIG. 2 than the other three cams.

This enables an end of the right linear portion of the three-holes-punching cam 73A and an end of the left linear portion of the three-holes/two-holes-punching cam 73B (73D) to face each other in a vertical direction. This further enables the right linear portion 78E of the three-holes/two-holes-punching cam 73B (73D) and the left linear portion 79E of the two-holes-punching cam 73E to face each other almost entirely, enabling the punches 68A, 68B, 68C, 68D, and 68E to be spaced by standard values.

The respective positions of the cams 73A, 73B, 73C, 73D, and 73E are shifted in a movement direction of the punches 68A, 68B, 68C, 68D, and 68E so that the cams are not successively arranged. This arrangement prevents the unnecessary punches from operating.

Furthermore, although the three-holes-punching punches 68A, 68B, and 68C are evenly spaced, the three-holes-punching cam 73A, the three-holes/two-holes-punching cam 73B (D), and the three-holes-punching cam 73C are unevenly spaced. Moreover, the distance between the three-holes-punching punches differs from the distance between the three-holes-punching cams. Similarly, the distance between the two-holes-punching punches 68D and 68E differs from the distance between the two-holes-punching cams 73D and 73E. The reason for this is that the movement of the cam member 72 causes the three three-holes-punching punches or the two two-holes-punching punches to respectively operate at a predetermined time interval to punch holes in the sheet P. As a result, a cam member drive motor 92, described below, can perform a smooth punching operation without being subjected to an overload.

A rack 91 is formed at a right end of the cam member 72. A pinion 94, which is rotated by the cam member drive motor 92 provided on the frame 52 meshes with the rack 91.

Three punch operating state detection flags 101, 102, and 103 project upward at the right end of the cam member 72. A cam member home position detection sensor 56 for detecting the three punch operating state detection flags 101, 102, and 103 is provided on the top plate 66 of the upper frame 62. The three punch operating state detection flags 101, 102, and 103 and the cam member home position sensor 56 function as a position detection unit for detecting the position of the cam member 72, in other words, detect whether the punches 68A, 68B, 68C, 68D, and 68E are at positions spaced apart from the sheet P or positions penetrating the sheet P in the reciprocating direction. The home position is hereinafter abbreviated as "HP".

Furthermore, one cam member state detection flag 105 is attached to the right end of the cam member 72. A cam member movement direction detection sensor 57 and a cam member region detection sensor 58 for detecting the cam member state detection flag 105 are spaced apart from each other in a movement direction of the cam member 72 on the back plate 67 of the upper frame 62.

The cam member region detection sensor 58 detects whether the cam member 72 is in a region where a three-holes-punching punch is to be operated, or a region where a two-holes-punching punch is to be operated depending on whether it detects the cam member state detection flag 105.

Furthermore, the cam member movement direction detection sensor 57 determines the movement direction of the cam member 72 during the punching operation depending on whether it detects the cam member state detection flag 105.

Figure 4:
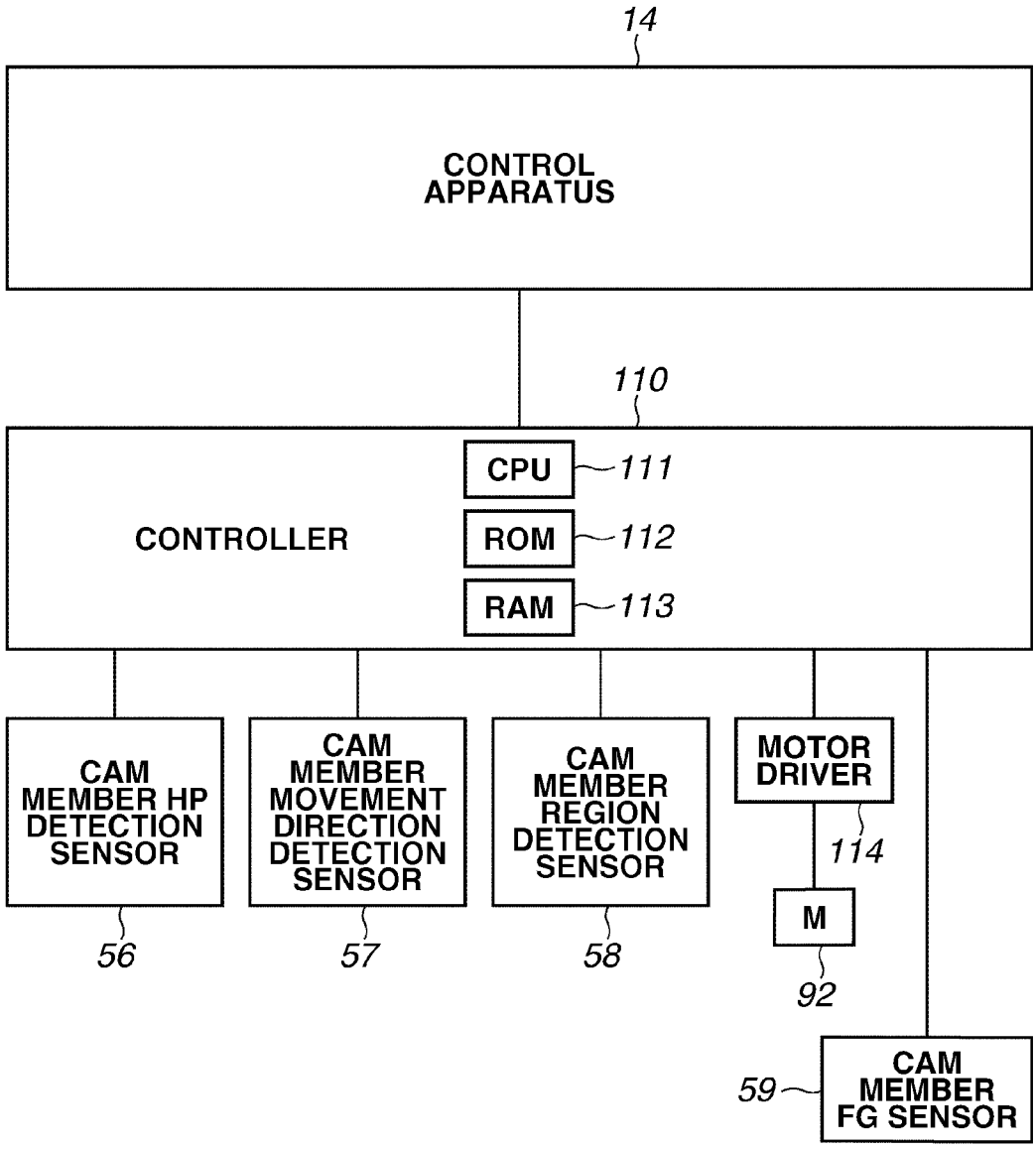
FIG. 4 is a diagram illustrating the configuration of a controller for controlling a punching apparatus.

The configuration of a controller 110 for controlling the punching apparatus 50 loaded in the finisher 4 will be then described with reference to FIG. 4. The controller 110 is incorporated into the processing control apparatus 46 illustrated in FIG. 1 and contains a central processing unit (CPU) 111, a read-only memory (ROM) 112, and a random-access-memory (RAM) 113, to collectively control the punching apparatus 50 through a control program stored in the ROM 112. The RAM 113 temporarily holds control data and is used as a work area of arithmetic processing involved in the control.

The cam member HP sensor 56, the cam member movement direction detection sensor 57, and the cam member region detection sensor 58 are connected to the controller 110.

Respective signals detected by the various sensors 56, 57, and 58 are input to the controller 110, and are used for controlling the punching apparatus 50. The cam member drive motor 92 is a driving source for reciprocally moving the cam member 72 in the punching apparatus 50 right and left to punch holes in the sheet P.

A motor driver 114 controls the cam member drive motor 92 using the control signal from the controller 110. A cam member FG sensor 59 functions as an encoder and detects slits of a slit disk 93 installed in a rotation shaft of the cam member drive motor 92. A signal detected by the cam member FG sensor 59 is input to the controller 110 so that the controller 110 calculates the number of revolutions of the cam member drive motor 92 and the movement distance of the cam member 72. More specifically, the cam member FG sensor 59 functions as a pulse generation unit for generating pulses corresponding to an amount of movement of the cam member 72.

Figure 5A:
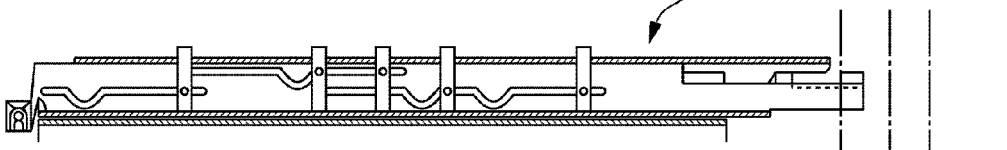
FIGS. 5A to 5G are diagrams illustrating an operating state of a cam member.
Figure 5B:
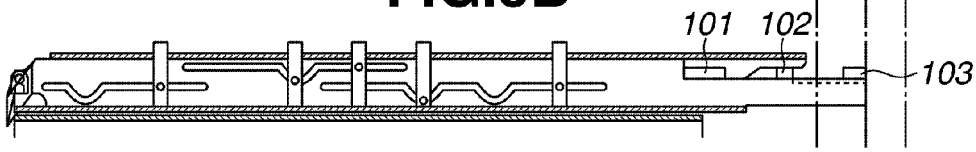
Figure 5C:
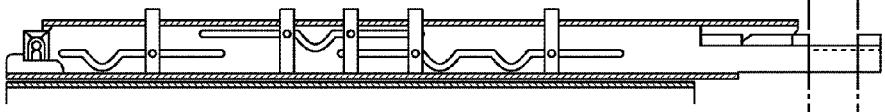

FIG. 5 is a diagram illustrating the operating state of the cam member 72. FIG. 6 is a diagram illustrating the respective ON/OFF logical states of the cam member HP sensor 56, the cam member movement direction detection sensor 57, and the cam member region detection sensor 58 corresponding to the position of the cam member 72. As illustrated in FIG. 6, regions where the cam member 72 is positioned are classified into a two-hole stop region A, two-hole punching regions B and C, a stop region D at the center, three-hole punching regions E and F, and a three-hole stop region G depending on the respective logical states of outputs (1, 0) of the cam member HP sensor 56, the cam member movement direction detection sensor 57, and the cam member region detection sensor 58. The cam member 72 is moved rightward from the left in FIG. 5 so that the regions where the cam member 72 is positioned are shifted to A, B, C, D, E, F, and G illustrated in FIG. 6 in this order.

The regions A to G illustrated in FIG. 6 respectively correspond to states illustrated in FIGS. 5A to 5G.

The punching operation of the punching apparatus 50 will be described.

FIG. 7 is a flowchart for describing the operation of the punching apparatus 50. The CPU 111 in the controller 110 performs the operation described with reference to the flowchart of FIG. 7. In step S602, the CPU 111 performs an initializing operation of the punching apparatus 50 upon receipt of a control signal for starting the operation from the control apparatus 14 in the copying machine main body 2.

Figure 8:
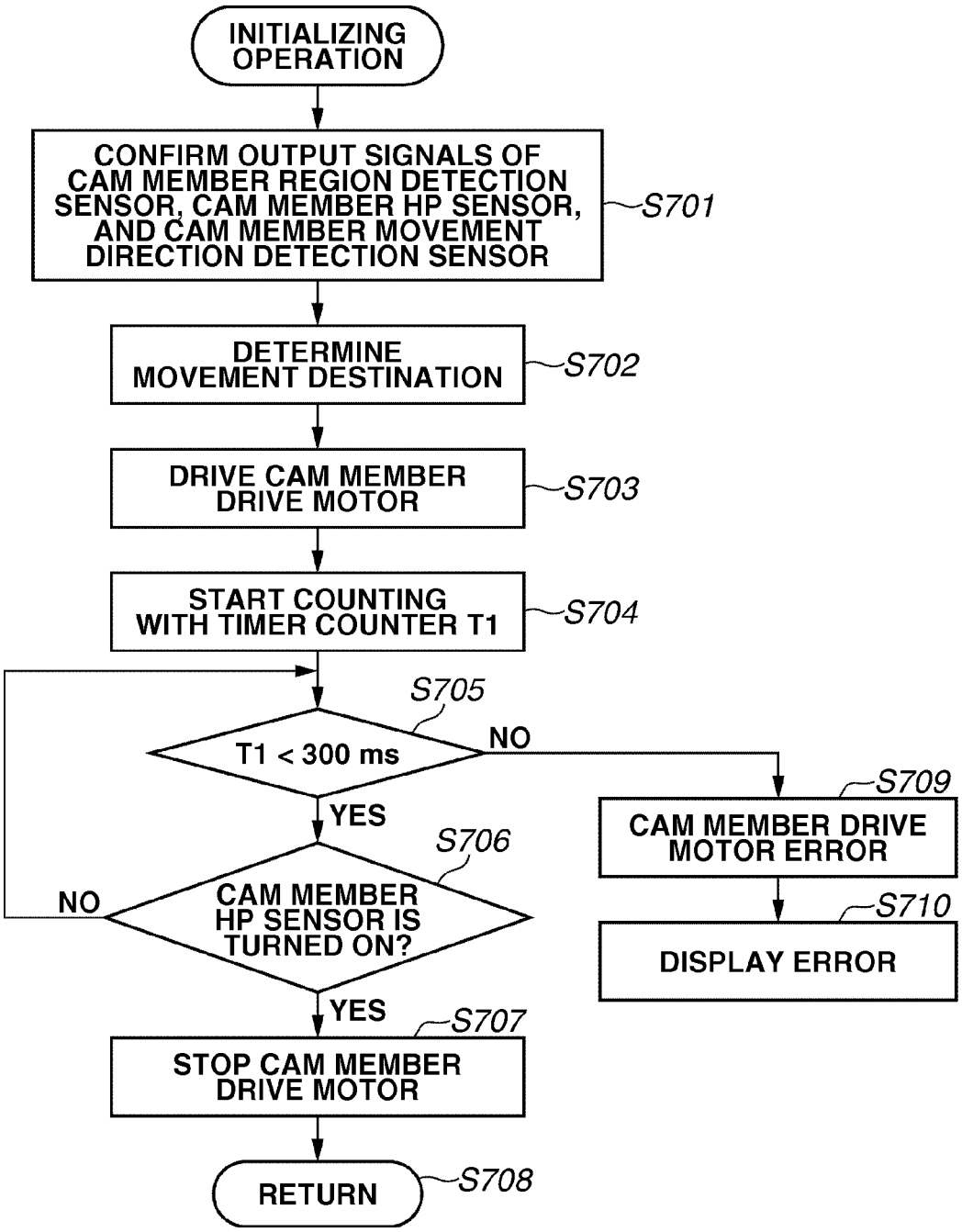
FIG. 8 is a flowchart illustrating an initializing operation of a punching apparatus.

The details of the initializing operation in step S602 will be described with reference to a flowchart of FIG. 8.

In the initializing operation, the cam member 72 is moved to the home position to reliably perform the punching operation. In step S701, the CPU 111 confirms respective output signals (ON/OFF) of the cam member HP sensor 56, the cam member movement direction detection sensor 57, and the cam member region detection sensor 58. The CPU 111 determines in which of the regions A to G illustrated in FIG. 6 the cam member 72 is positioned by the values of the signals.

As can be seen from FIG. 6, the cam member 72 is in the punching region E when the output signal of the cam member HP sensor 56 is OFF, the output signal of the cam member movement direction detection sensor 57 is ON, and the output signal of the cam member region detection sensor 58 is ON, for example. The punching apparatus 50 at this time is in the state illustrated in FIG. 5F. In step S702, the CPU 111 determines a movement destination of the cam member 72 in the initializing operation by a determined initial position of the cam member 72.

FIG. 9 illustrates a table representing the movement destination determined by a combination of the respective output signals of the cam member HP sensor 56, the cam member movement direction detection sensor 57, and the cam member region detection sensor 58. For example, when the determined initial position of the cam member 72 is in the stop region A or the punching region B, the movement destination is the stop region D. When the initial position is in the punching region C, the movement destination is the stop region A. When the initial position is in the stop region D or the punching region E, the movement destination is the stop region G. When the initial position is in the punching region F or the stop region G, the movement destination is in the stop region D.

The movement destination in the initializing operation is thus determined according to the table illustrated in FIG. 9. In step S703, when the movement destination is determined, the CPU 111 feeds a control signal to the motor driver 114 for driving the cam member drive motor 92.

Specific examples of the control signal for driving the cam member drive motor 92 include a motor ON signal, a motor normal rotation/reverse rotation signal, and a motor reverse rotation signal. When the region at the movement destination (any one of A to G) of the cam member 72 precedes in alphabetic order the region at the initial position (any one of A to G) thereof (e.g., the cam member 72 moves from the region C to the region A), the cam member 72 moves rightward from the left in FIGS. 5A to 5G. At this time, the motor normal rotation/reverse rotation signal becomes one (an H level), so that the CPU 111 rotates the motor shaft in a clockwise direction. On the other hand, when the region at the initial position precedes in alphabetic order the region at the movement destination (e.g., the cam member 72 moves from the region D to the region G), the cam member 72 moves leftward from the right in FIGS. 5A to 5G. At this time, the motor normal rotation/reverse rotation signal becomes zero (an L level), so that the CPU 111 rotates the motor shaft in a counterclockwise direction.

The CPU 111 subjects the motor ON signal to pulse width modulation (PWM) control such that the driving speed of the cam member drive motor 92 becomes a target speed V1, to carry out speed control. The speed of the cam member drive motor 92 is detected based on the pulses output from the cam member FG sensor 59. Since the gear ratio of the rack 91 and the pinion 94 is 1:1, the target speed of the cam member drive motor 92 is also the target movement speed of the cam member 72.

In step S704, the CPU 111 starts counting with a timer counter T1 in synchronization with the start of driving of the cam member drive motor 92. In step S705, the CPU 111 then determines whether the timer counter T1 satisfies T1<300 msec. If T1<300 msec (YES in step S705), then in step S706, the CPU 111 determines whether the cam member HP sensor 56 is turned on. If the cam member HP sensor 56 is turned on (YES in step S706), the cam member 72 moves to any one of the stop regions (HP regions). If the cam member HP sensor 56 is turned on, then in step S707, the CPU 111 stops transmitting the control signal for driving the cam member drive motor 92 to the motor driver 114, to stop the cam member drive motor 92. If the cam member HP sensor 56 remains off (NO in step S706), the processing returns to step S705. In step S705, the CPU 111 monitors the timer counter T1 again.

If the timer counter T1 satisfies T1≧300 msec (NO in step S705), any abnormality occurs in the operation of the cam member drive motor 92 or the movement of the cam member 72, so that the cam member 72 cannot reach the stop region. In this case, in step S709, the CPU 111 stops the cam member drive motor 92, and determines that a driving error of the cam member drive motor 92 occurs. In step S710, the CPU 111 further displays the driving error on a display panel (not illustrated) provided in the sheet processing apparatus 1 or the copying machine main body 2. The stop of the operation of the punching apparatus 50 prevents a damage to the punching apparatus 50. In step S708, the controller 110 thus completes the initializing operation.

While the above has described the initializing operation of the punching apparatus 50 including the three stop regions A, D, and G illustrated in FIG. 6, the same is true for the initializing operation of a punching apparatus 50 including two stop regions. More specifically, in the punching apparatus including the two stop regions, a cam member 72 moves in a range from the stop region A to the stop region D or a range from the stop region D to the stop region G according to the regions illustrated in FIG. 6. The table illustrated in FIG. 9 can be also applied to this case.

More specifically, in the punching apparatus 50 in which the cam member 72 moves in the range from the stop region A to the stop region D, when the cam member 72 is in the stop region A or the punching region B before the initializing operation, the cam member 72 moves to the stop region D. When the cam member 72 is in the punching region C or the stop region D before the initializing operation, the cam member 72 moves to the stop region A.

In the punching apparatus 50 in which the cam member 72 moves in the range from the stop region D to the stop region G, when the cam member 72 is in the stop region D or the punching region E before the initializing operation, the cam member 72 moves to the stop region G. When the cam member 72 is in the punching region F or the stop region G before the initializing operation, the cam member 72 moves to the stop region D.

The table illustrated in FIG. 9 shows that in the initializing operation of the punching apparatus 50 including the three stop regions, the cam member 72 moves to the stop region D, when the initial region is the stop region A or the punching region B. The cam member 72 moves to the stop region A, when the initial region is the punching region C. The cam member 72 moves to the stop region G, when the initial region is the stop region D or the punching region E. The cam member 72 moves to the stop region D when the initial region is the punching region F or the stop region G, i.e., the cam member 72 moves to the farther stop region. The same is true for the initializing operation of the punching apparatus 50 including the two stop regions.

Returning to FIG. 7, after the initializing operation in step S602 is completed, a signal representing job start is transmitted from the control apparatus 14 in the copying machine main body 2 (see FIG. 1) to the processing control apparatus 46 for controlling the punching apparatus 50. Simultaneously, sheet size data for the sheets P conveyed from the copying machine main body 2 to the punching apparatus 50 are transmitted one by one. In step S604, the CPU 111 acquires the sheet size data. In step S605, the CPU 111 determines whether the sheet size represented by the sheet size data is a punchable sheet size. More specifically, the sheet size data includes sheet length data L and sheet width data W. If the acquired sheet length data L and sheet width data W are respectively 200 mm and 148 mm, for example, this size is not the punchable sheet size (NO in step S605). Therefore, the CPU 111 does not permit the punching operation, and does not perform the punching operation. The CPU 111 acquires the subsequent sheet size data.

If the sheet size represented by the sheet size data acquired in step S605 is the punchable sheet size (YES in step S605), the CPU 111 determines which of the regions the cam member 72 is positioned in. In the above-mentioned initializing operation in step S602, the cam member 72 should have moved to any one of the stop region A, the stop region D, and the stop region G illustrated in FIG. 6. More specifically, the CPU 111 determines that the cam member 72 exists in any one of the stop region A, the stop region D, and the stop region G illustrated in FIG. 6. In step S606, the CPU 111 makes the determination by detecting the ON/OFF state of the cam member HP sensor 56.

If the CPU 111 cannot determine that the cam member 72 is in any one of the stop region A, the stop region D, and the stop region G illustrated in FIG. 6 (NO in step S606), then in step S617, the CPU 111 determines that a driving error of the cam member drive motor 92 has occurred because the punching operation cannot be ensured. If the driving error has occurred, then in step S618, the CPU 111 further stops the operation of the punching apparatus 50, to display the driving error on a display panel (not illustrated) provided in the sheet processing apparatus 1 or the copying machine main body 2. If the CPU 111 can determine that the cam member 72 is in any one of the stop region A, the stop region D, and the stop region G illustrated in FIG. 6 (YES in step S606), the processing proceeds to step S607.

In step S607, the CPU 111 makes sheet width determination, to detect whether the sheet width data W in the sheet size data acquired in step S604 is in a range of 266 mm<W<298 mm. The CPU 111 determines that the sheet size represented by the sheet size data is the size of the sheet P in which three holes are to be punched if the sheet width data W is in the range of 266 mm<W<298 mm (YES in step S607). If not, the CPU 111 determines that the sheet size is the size of the sheet P in which two holes are to be punched (NO in step S607). Even if the sheet width data W is in a range of 266 mm<W, three holes may be punched. In other words, it is determined whether two holes or three holes are to be punched depending on the size of the sheet P.

If the sheet width data W is in the range of 266 mm<W<298 mm in the sheet width determination (YES in step S607), then in step S608, the CPU 111 determines whether the cam member 72 is in a region where three holes can be punched. More specifically, if the CPU 111 determines that the cam member 72 is in the stop region D or the stop region G illustrated in FIG. 6 (YES in step S608), then in step S610, the CPU 111 performs a three holes punching operation. The three holes punching operation will be described below. If the CPU 111 determines that the cam member 72 is in the stop region A illustrated in FIG. 6 (NO in step S608), then in step S609, the CPU 111 performs a two holes/three holes switching operation because three holes cannot be punched, to move the cam member 72 to the stop region D where three holes can be punched. Furthermore, if the sheet width data W is outside the range of 266 mm<W<298 mm in the sheet width determination (NO in step S607), then in step S612, the CPU 111 also determines whether the cam member 72 is in a region where two holes (a first number of holes or a second number of holes) can be punched. More specifically, if the CPU 111 determines that the cam member 72 is in the stop region A or the stop region D illustrated in FIG. 6 (YES in step S612), then in step S614, the CPU 111 performs a two holes punching operation. The two holes punching operation will be also described below. If the CPU 111 determines that the cam member 72 is in the stop region G illustrated in FIG. 6 (NO in step S612), then in step S613, the CPU 111 performs a three holes/two holes switching operation because two holes cannot be punched. The three holes/two holes switching operation will be also described below.

In step S615, after terminating the punching operation, the CPU 111 determines whether a job continuation signal has been received from the control apparatus 14 in the copying machine main body 2. If the job continuation signal has been received (YES in step S615), the processing returns to step S604. In step S604, the CPU 111 acquires sheet size data for the subsequent sheet P. If the job continuation signal has not been received (NO in step S615), then in step S616, the CPU 111 determines that a job is completed, to terminate a series of punching operations.

Figure 10:
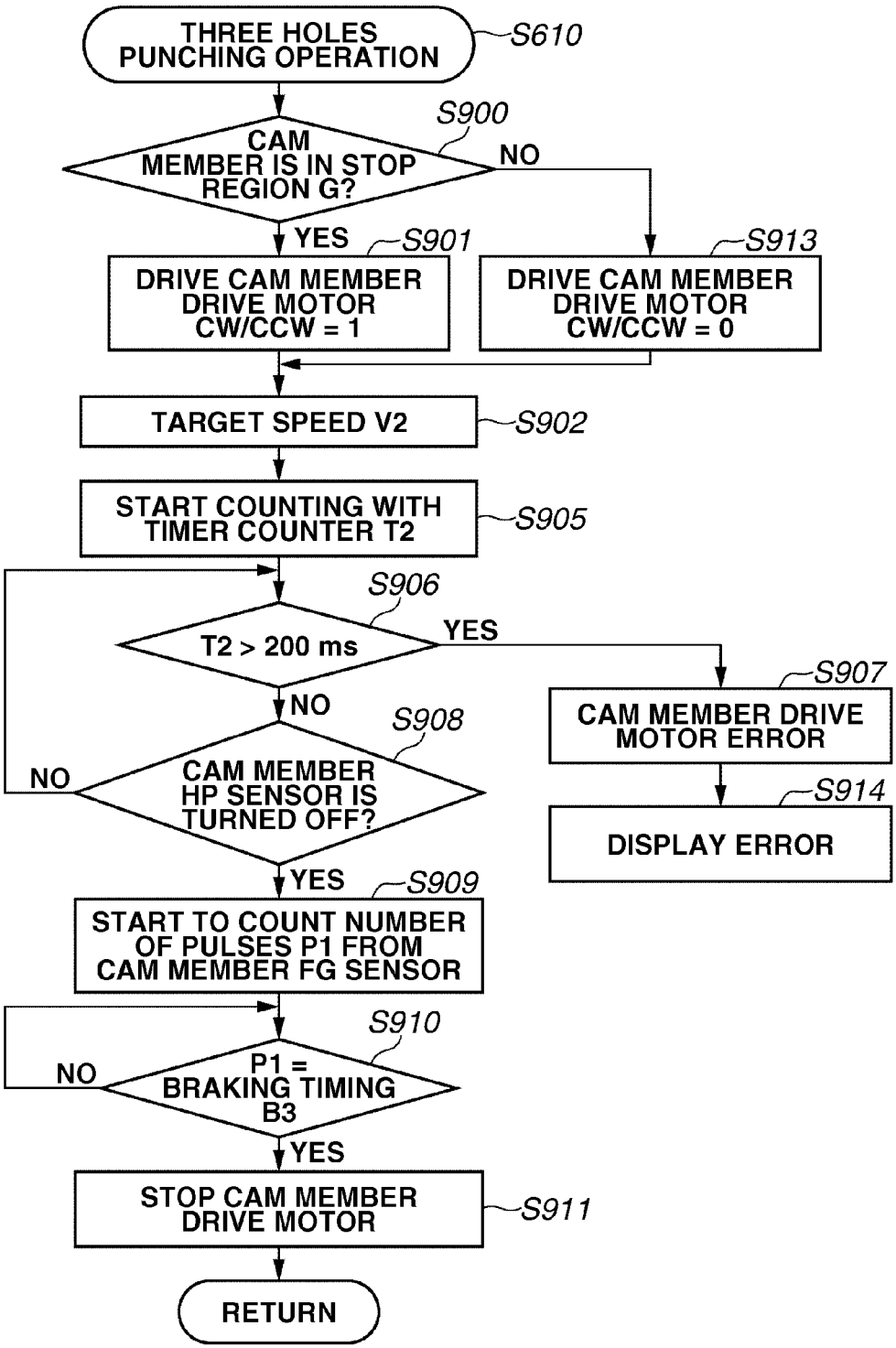
FIG. 10 is a flowchart illustrating a three holes punching operation of a punching apparatus.

The details of the three holes punching operation in step S610 illustrated in FIG. 7 will be described with reference to a flowchart of FIG. 10.

When the sheet P is conveyed, the sheet P is guided to the space S. Thereafter, the conveyance of the sheet P is stopped at a position where an upstream edge of the sheet P faces the punches 68A, 68B, 68C, 68D, and 68E. In step S900, the CPU 111 determines whether the cam member 72 is in the stop region G illustrated in FIG. 6 at this time. If the cam member 72 is in the stop region G (YES in step S900), the cam member 72 has been brought closer to the right, as illustrated in FIG. 5G.

In order to punch holes in the sheet P, the cam member 72 must be moved leftward from the right in FIG. 5. The CPU 111 controls the cam member drive motor 92 such that the cam member 72 is moved leftward from the right in FIG. 5G. Thus moving the cam member 72 from the stop region G to the stop region D is referred to as three holes punching normal rotation control.

In step S901, after the conveyance of the sheet P is stopped, the CPU 111 feeds the control signal to the motor driver 114 for driving the cam member drive motor 92. Specific examples of the control signal for driving the cam member drive motor 92 include a motor ON signal, a motor normal rotation/reverse rotation signal, and a motor reverse rotation signal. In normal rotation control, the motor normal rotation/reverse rotation signal becomes one (an H level), so that the CPU 111 rotates the motor shaft in a clockwise direction.

In step S902, the CPU 111 then subjects the driving control signal (motor ON signal) of the cam member drive motor 92 to PWM control such that the speed of the cam member drive motor 92 becomes a target speed V2. The speed of the cam member drive motor 92 is detected based on the pulses from the cam member FG sensor 59.

If the cam member drive motor 92 rotates, then in step S905, the CPU 111 starts counting with a timer counter T2. The timer counter T2 detects an operation failure of the cam member drive motor 92. In continuing the processing in step S905 and the subsequent steps, the CPU 111 always monitors the cam member drive motor 92. In step S906, the CPU 111 determines whether the timer counter T2 satisfies T2>200 msec. If T2>200 msec (YES in step S906), then in step S907, the CPU 111 determines that an error of the cam member drive motor 92 has occurred. In other words, the CPU 111 determines that the cam member drive motor 92 does not move because any abnormality occurs in the operation of the cam member drive motor 92 or the movement of the cam member 72. If the driving error has occurred, then in step S914, the CPU 111 stops the operation of the punching apparatus 50 to prevent a damage to the punching apparatus 50, to display the driving error on a display panel (not illustrated) provided in the sheet processing apparatus 1 or the copying machine main body 2.

In this state, the cam member 72 is moved by the pinion 93 and the rack 91 so that the regions where the cam member 72 is positioned are shifted to G, F, E, and D illustrated in FIG. 6 in this order. During this period, the three-holes-punching punches 68A, 68B, and 68C are respectively lowered by the three-holes-punching cams 73A, 73B, and 73C, and are raised after punching three holes in the sheet P.

In step S908, the CPU 111 then waits until the cam member HP sensor 56 is turned off. If the cam member HP sensor 56 is turned off (YES in step S908), then in step S909, the CPU 111 starts to count the number of pulses P1 from the cam member FG sensor 59. In step S910, the CPU 111 determines whether the number of pulses P1 from the cam member FG sensor 59 has reached braking timing B3. If P1=B3 (YES in step S910), then in step S911, the CPU 111 stops the control signal for driving the cam member drive motor 92, to stop the cam member drive motor 92.

The braking timing B3 means braking timing at the time of punching three holes. The braking timing B3 complements a variation in an amount of overrun of a cam member depending on a difference among machines. Therefore, the braking timing B3 is corrected when the power to the sheet processing apparatus 1 is turned on. A method for correcting the braking timing B3 will be described below. Thus, the variation in the amount of overrun depending on the difference among machines is complemented so that the cam member 72 can be reliably stopped in the stop region D illustrated in FIG. 6. The output of the cam member HP sensor 56 at this time changes as follows. The output of the cam member HP sensor 56 is turned "OFF" once from an "ON" state by the punching operation state detection flag 101 at the left end out of the punching operation state detection flags 101, 102, and 103. Then, the output returns to the "ON" state by the punching operation state detection flag 102 at the center. A range where the flag 102 is detected corresponds to the stop region.

Even if the cam member drive motor 92 is stopped, the cam member 72 is advanced by the inertia of the cam member drive motor 92 or the cam member 72 itself. The cam member 72 is stopped at a position where the cam member HP sensor 56 completely faces the punching operation state detection flag 102 at the center (the stop region D illustrated in FIG. 6).

Figure 5D:
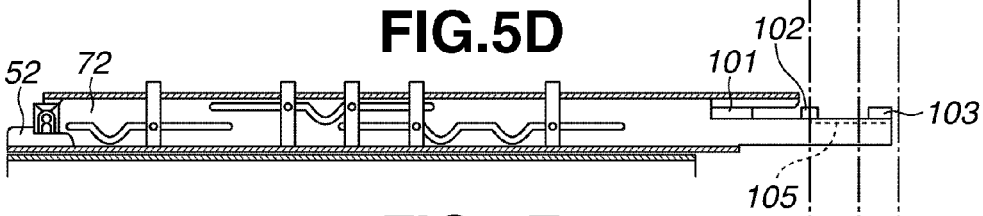
Figure 5E:
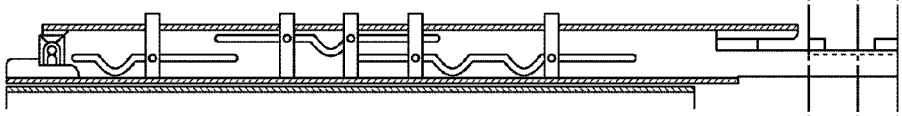
Figure 5F:
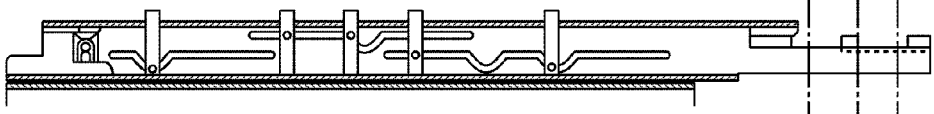
Figure 5G:
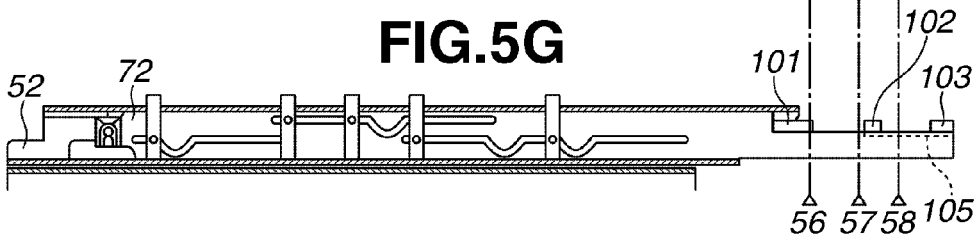
Figure 6:
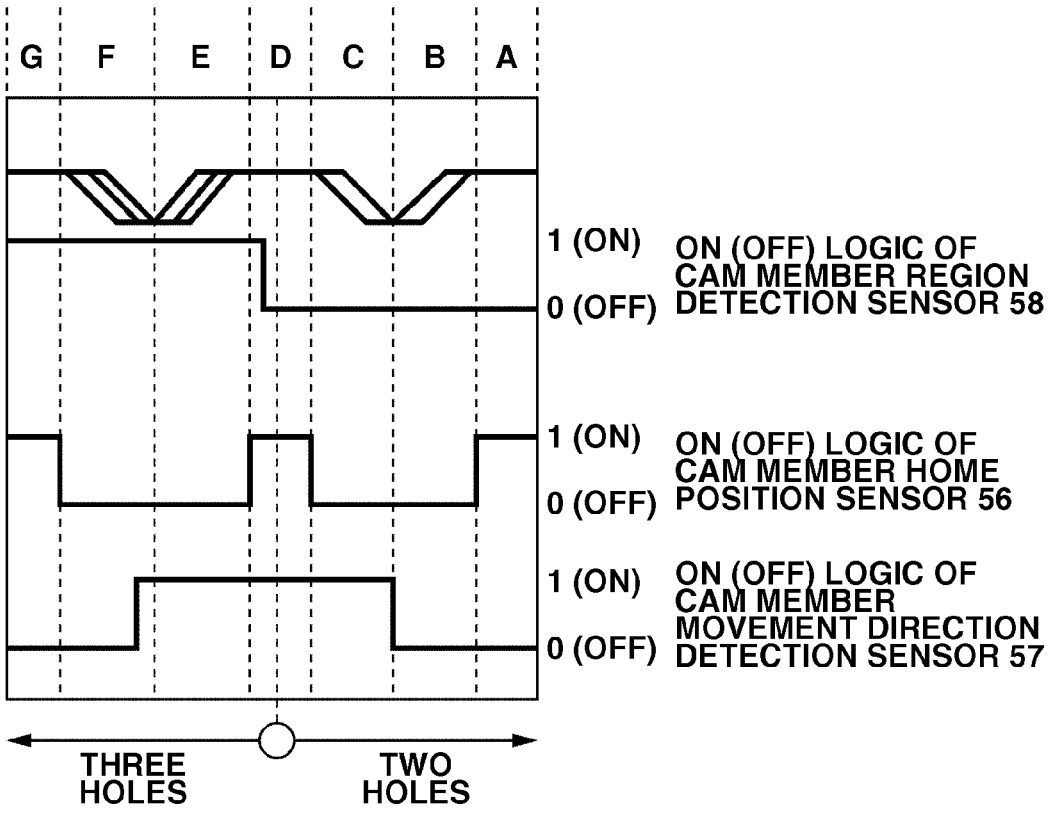
FIG. 6 is a diagram illustrating the ON/OFF logic of a cam member detection sensor.

If the cam member 72 is not in the stop region G but the stop region D in FIG. 6 (NO in step S900), the cam member 72 is positioned at the center, as illustrated in FIG. 5D.

In order to punch holes in the sheet P, the cam member 72 must be moved rightward from the center. The CPU 111 controls the cam member drive motor 92 such that the cam member 72 is moved rightward from the center in FIG. 5D. Thus moving the cam member 72 from the stop region D to the stop region G is referred to as three holes punching reverse rotation control. The subsequent operations are the same as those in the above-mentioned three holes punching normal rotation control except that the motor normal rotation/reverse rotation signal conversely becomes zero (an L level), so that the CPU 111 rotates the motor shaft in a counterclockwise direction. The cam member 72 is moved rightward from the left by the pinion 93 and the rack 91 so that the state of the cam member 72 is shifted to FIGS. 5D, 5E, 5F, and 5G in this order.

When the cam member 72 is stopped in the stop region G, the output of the cam member HP sensor 56 changes as follows. The output of the cam member HP sensor 56 is turned "OFF" once from an "ON" state by the punching operation state detection flag 102 at the center out of the three punching operation state detection flags 101, 102, and 103, and then returns to the "ON" state by the punching operation state detection flag 101 at the left end.

When the cam member drive motor 92 is stopped, the cam member HP sensor 56 is stopped at a position where the cam member HP sensor 56 completely faces the punching operation state detection flag 101 at the left end (the stop region G illustrated in FIG. 6).

Figure 11:
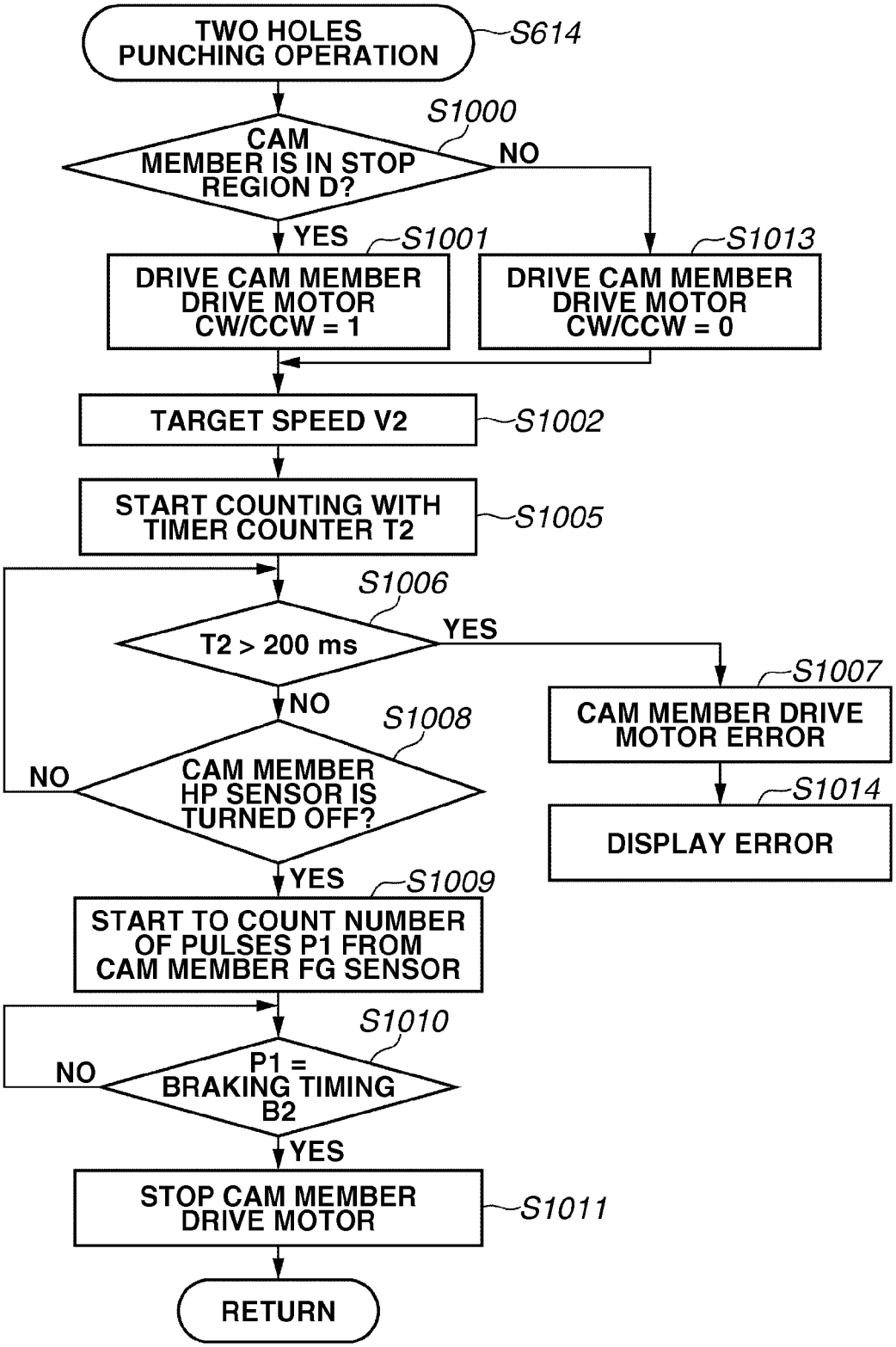
FIG. 11 is a flowchart illustrating a two holes punching operation of a punching apparatus.

The details of the two holes punching operation in step S614 illustrated in FIG. 7 will be described with reference to a flowchart of FIG. 11.

When the sheet P is conveyed, the sheet P is guided to the space S. Thereafter, the conveyance of the sheet P is stopped at a position where an upstream edge of the sheet P faces the punches 68A, 68B, 68C, 68D, and 68E. In step S1000, the CPU 111 determines whether the cam member 72 is in the stop region D illustrated in FIG. 6 at this time. If the cam member 72 is in the stop region D (YES in step S1000), the cam member 72 is positioned at the center, as illustrated in FIG. 5D.

In order to punch holes in the sheet P, the cam member 72 must be moved leftward from the center. The CPU 111 controls the cam member drive motor 92 such that the cam member 72 is moved leftward from the center in FIG. 5D. Thus moving the cam member 72 from the stop region D to the stop region A is referred to as two holes punching normal rotation control.

If the conveyance of the sheet P is stopped, then in step S1001, the CPU 111 feeds the control signal to the motor driver 114 for driving the cam member drive motor 92. Specific examples of the control signal for driving the cam member drive motor 92 include a motor ON signal, a motor normal rotation/reverse rotation signal, and a motor reverse rotation signal. In the normal rotation control, the motor normal rotation/reverse rotation signal becomes one (an H level), so that the CPU 111 rotates the motor shaft in a clockwise direction.

In step S1002, the CPU 111 subjects the motor ON signal to PWM control such that the speed of the cam member drive motor 92 becomes the target speed V2.

If the cam member drive motor 92 rotates, then in step S1005, the CPU 111 starts counting with the timer counter T2. In step S1006, the CPU 111 determines whether the timer counter T2 satisfies T2>200 msec. If T2>200 msec (YES in step S1006), then in step S1007, the CPU 111 determines that an error of the cam member drive motor 92 has occurred. If the driving error has occurred, then in step S1014, the CPU 111 stops the operation of the punching apparatus 50, to display the driving error on a display panel (not illustrated) provided in the sheet processing apparatus 1 or the copying machine main body 2.

In this state, the cam member 72 is moved by the pinion 93 and the rack 91 so that the state of the cam member 72 is shifted to FIGS. 5D, 5C, 5B, and 5A in this order. During this period, the two-holes-punching punches 68D and 68E are respectively lowered by the two-holes-punching cams 73D and 73E, and are raised after punching two holes in the sheet P.

In step S1008, the CPU 111 then waits until the cam member HP sensor 56 is turned off. If the cam member HP sensor 56 is turned off (YES in step S1008), then in step S1009, the CPU 111 starts to count the number of pulses P1 from the cam member FG sensor 59. In step S1010, the CPU 111 determines whether the number of pulses P1 from the cam member FG sensor 59 has reached braking timing B2. If P1=B2 (YES in step S1010), then in step S1011, the CPU 111 stops the control signal for driving the cam member drive motor 92, to stop the cam member drive motor 92.

The braking timing B2 means braking timing at the time of punching two holes. The braking timing B2 complements a variation in an amount of overrun of a cam member 72 depending on a difference among machines. The braking timing B2 is corrected when the power to the sheet processing apparatus 1 is turned on. A method for correcting the braking timing B2 will be described below. Thus, the variation in the amount of overrun depending on the difference among machines is complemented and the cam member 72 can be reliably stopped in the stop region A illustrated in FIG. 6. The output of the cam member HP sensor 56 at this time changes as follows. The output of the cam member HP sensor 56 is turned "OFF" once from an "ON" state by the punching operation state detection flag 102 at the center out of the three punching operation state detection flags 101, 102, and 103, and then returns to the "ON" state by the punching operation state detection flag 103 at the right end.

Even if the cam member drive motor 92 is stopped, the cam member 72 is advanced by the inertia of the cam member drive motor 92 or the cam member 72 itself and stopped at a position where the cam member HP sensor 56 completely faces the punching operation state detection flag 103 at the right end (the stop region A illustrated in FIG. 6).

If the cam member 72 is not in the stop region D but the stop region A in FIG. 6 (NO in step S1000), the cam member 72 is brought closer to the left, as illustrated in FIG. 5A.

In order to punch holes in the sheet P in this case, the cam member 72 must be moved rightward from the left. The CPU 111 controls the cam member drive motor 92 such that the cam member 72 is moved rightward from the left in FIG. 5A. Thus moving the cam member 72 from the stop region A to the stop region D is referred to as two holes punching reverse rotation control. The subsequent operations are the same as those in the above-mentioned two holes punching normal rotation control except that the motor normal rotation/reverse rotation signal conversely becomes zero (an L level), so that the CPU 111 rotates the motor shaft in a counterclockwise direction. The cam member 72 is moved by the pinion 93 and the rack 91 so that the state of the cam member 72 is shifted to FIGS. 5A, 5B, 5C, and 5D in this order.

When the cam member 72 is stopped in the stop region D illustrated in FIG. 6, the output of the cam member HP sensor 56 changes as follows. The output of the cam member HP sensor 56 is turned "OFF" once from an "ON" state by the punching operation state detection flag 103 at the right end out of the three punching operation state detection flags 101, 102, and 103, and then returns to the "ON" state by the punching operation state detection flag 102 at the center.

When the cam member drive motor 92 is stopped, the cam member HP sensor 56 is stopped at a position where the cam member HP sensor 56 completely faces the punching operation state detection flag 102 at the center (the stop region D illustrated in FIG. 6).

Figure 12:
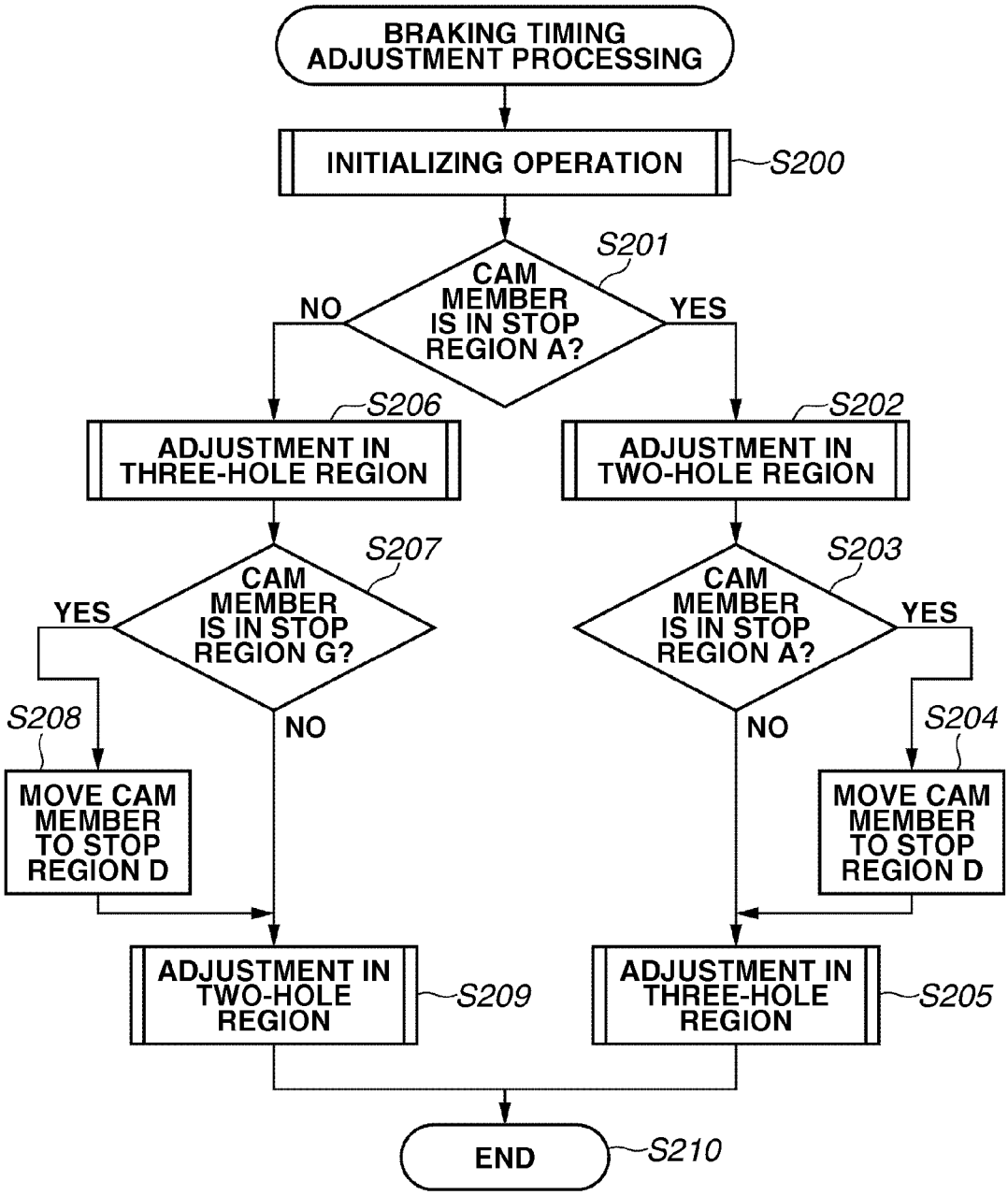
FIG. 12 is a flowchart illustrating an operation for braking timing adjustment of a punching apparatus.

Braking timing adjustment processing will be described with reference to FIG. 12.

The braking timing adjustment processing is performed when the power to the sheet processing apparatus 1 is turned on. In step S200, the CPU 111 first performs the above-mentioned initializing operation, to move the cam member 72 to the stop region. In step S201, the CPU 111 then determines whether the cam member 72 after undergoing the initializing operation is in the stop region A. If the cam member 72 is in the stop region A (YES in step S201), then in step S202, the CPU 111 makes a braking timing adjustment in a two-hole region. The details of the braking timing adjustment will be described below. In step S203, the CPU 111 then confirms whether the cam member 72 is in the stop region A at the time the braking timing adjustment in the two-hole region ends. If the cam member 72 is in the stop region A (YES in step S203), then in step S204, the CPU 111 moves the cam member 72 to the stop region D. In step S205, the CPU 111 makes a braking timing adjustment in a three-hole region. On the other hand, if the cam member 72 is not in the stop region A (NO in step S203), then in step S205, the CPU 111 makes the braking timing adjustment in the three-hole region without moving the cam member 72.

On the other hand, if the cam member 72 is not in the stop region A (NO in step S201), then in step S206, the CPU 111 makes the braking timing adjustment in the three-hole region. In step S207, the CPU 111 determines whether the cam member 72 is in the stop region G at the time the braking timing adjustment in the three-hole region ends. If the cam member 72 is in the stop region G (YES in step S207), then in step S208, the CPU 111 moves the cam member 72 to the stop region D. In step S209, the CPU 111 makes the braking timing adjustment in the two-hole region. On the other hand, if the cam member 72 is not in the stop region G (NO in step S207), then in step S209, the CPU 111 makes the braking timing adjustment in the two-hole region without moving the cam member 72.

Figure 13:
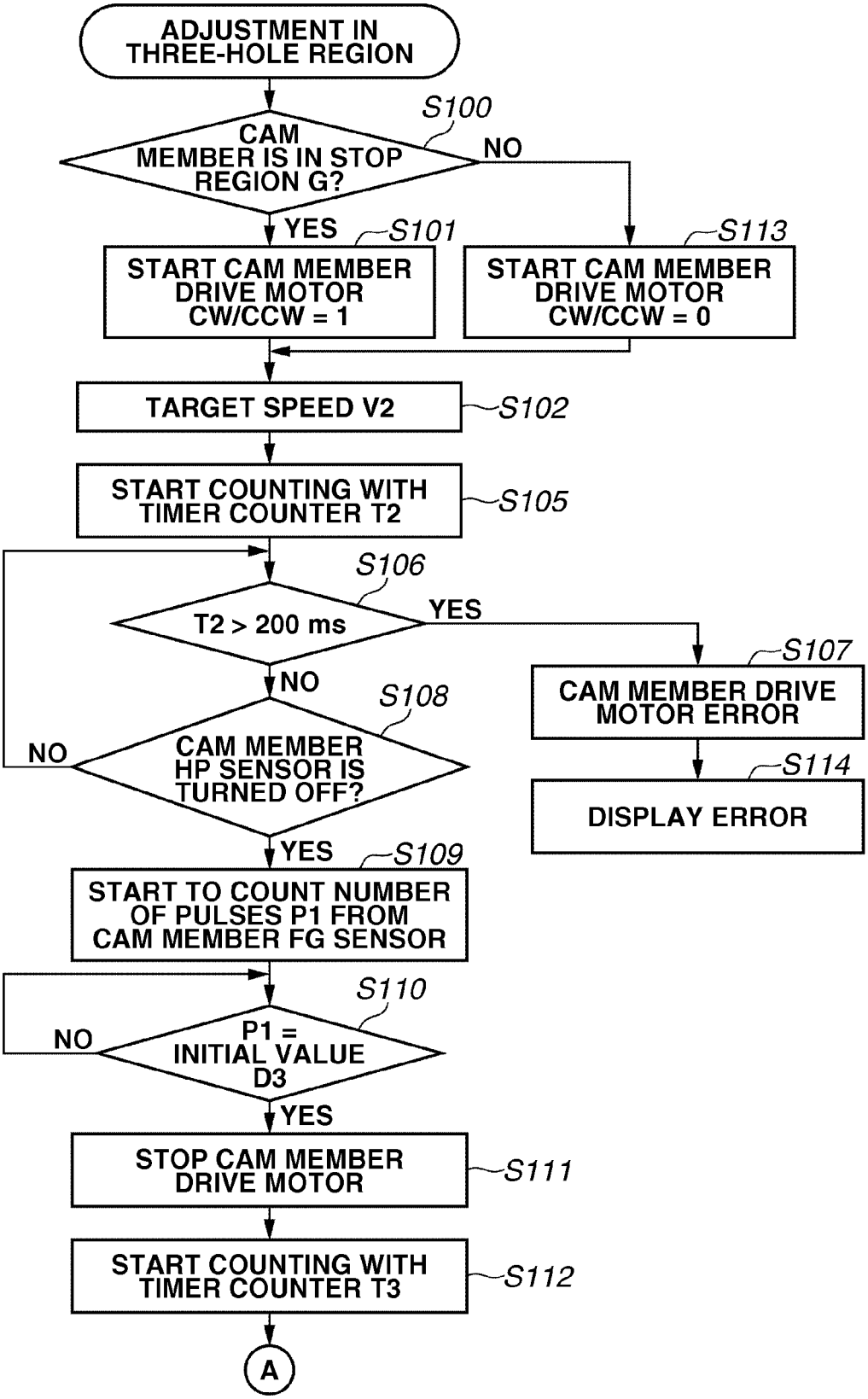
FIG. 13 is a flowchart illustrating an operation for braking timing adjustment in a three-hole region of a punching apparatus.

The braking timing adjustment processing in the three-hole region will be then described with reference to FIGS. 13 and 14.

In step S100, the CPU 111 first determines whether the cam member 72 is in the stop region G. If the cam member 72 is in the stop region G (YES in step S100), then in step S101, the CPU 111 sets the rotational direction of the cam member drive motor 92 to one (normal rotation), to start the cam member drive motor 92. On the other hand, if the cam member 72 is not in the stop region G (NO in step S100), then in step S113, the CPU 111 sets the rotational direction of the cam member drive motor 92 to zero (reverse rotation), to start the cam member drive motor 92.

In step S102, the CPU 111 subjects the control signal (motor ON signal) for driving the cam member drive motor 92 to PWM control such that the speed of the cam member drive motor 92 becomes the target speed V2. The speed of the cam member drive motor 92 is detected based on the pulses from the cam member FG sensor 59.

If the cam member drive motor 92 rotates, then in step S105, the CPU 111 starts counting with the timer counter T2. The timer counter T2 detects an operation failure of the cam member drive motor 92. In continuing the processing in step S105 and the subsequent steps, the CPU 111 always monitors the cam member drive motor 92. In step S106, the CPU 111 determines whether the timer counter T2 satisfies T2>200 msec. If T2>200 msec (YES in step S106), then in step S107, the CPU 111 determines that an error of the cam member drive motor 92 has occurred. More specifically, the CPU 111 determines that the cam member drive motor 92 does not move because any abnormality occurs in the operation of the cam member drive motor 92 or the movement of the cam member 72. If the driving error has occurred, then in step S114, the CPU 111 stops the operation of the punching apparatus 50 to prevent a damage to the punching apparatus 50, to display the driving error on a display panel (not illustrated) provided in the sheet processing apparatus 1 or the copying machine main body 2.

In step S108, the CPU 111 waits until the cam member HP sensor 56 is turned off. In this case, the cam member HP sensor 56 detects the passage of a trailing edge of the flag 101, i.e., a reference position. If the cam member HP sensor 56 is turned off (YES in step S108), then in step S109, the CPU 111 starts to count the number of pulses P1 from the cam member FG sensor 59. In step S110, the CPU 111 determines whether the number of pulses P1 from the cam member FG sensor 59 has reached an initial value D3 representing braking timing. If P1=D3 (YES in step S110), then in step S111, the CPU 111 stops the control signal for driving the cam member drive motor 92, to stop the cam member drive motor 92. The foregoing processing insteps S100 to S109 and S113 is substantially the same as that in the operation for punching holes in the actual sheet P, described in FIG. 10. In other words, a stop state where the brake is applied to the cam member drive motor 92 is reproduced. Instead of counting the pulses from the cam member FG sensor 59 in steps S109 and S110, the CPU 111 may measure time (clocks having a predetermined period) to stop the driving of the cam member drive motor 92 after an elapse of a predetermined period of time.

In step S110, after starting to count the number of pulses P1 from the cam member FG sensor 59 in step S109, the CPU 111 determines whether the number of pulses P1 from the cam member FG sensor 59 has reached the initial value D3. If P1=D3 (YES in step S110), then in step S111, the CPU 111 stops the control signal for driving the cam member drive motor 92, to stop the cam member drive motor 92. The foregoing processing in steps S100 to S111 and step S113 corresponds to first driving processing for stop position adjustment.

In step S112, the CPU 111 then starts counting with a timer counter T3. In step S115, the CPU 111 determines whether the cam member HP sensor 56 is turned on. In this case, the cam member HP sensor 56 detects the passage of a leading edge of the flag 102. The timer counter T3 counts 200 ms that is a period of time which elapses since an operation for stopping the cam member drive motor 92 was performed until the cam member drive motor 92 is reliably stopped.

If the cam member HP sensor 56 is turned on (YES in step S115), then in step S116, the CPU 111 waits until a count value of the timer counter T3 reaches 200 ms. In step S117, the CPU 111 determines again whether the cam member HP sensor 56 is tuned on. If the cam member HP sensor 56 is turned on (YES in step S117), the cam member 72 could be stopped in the stop region (a region including a target stop position) during the braking timing adjustment.

Figure 15:
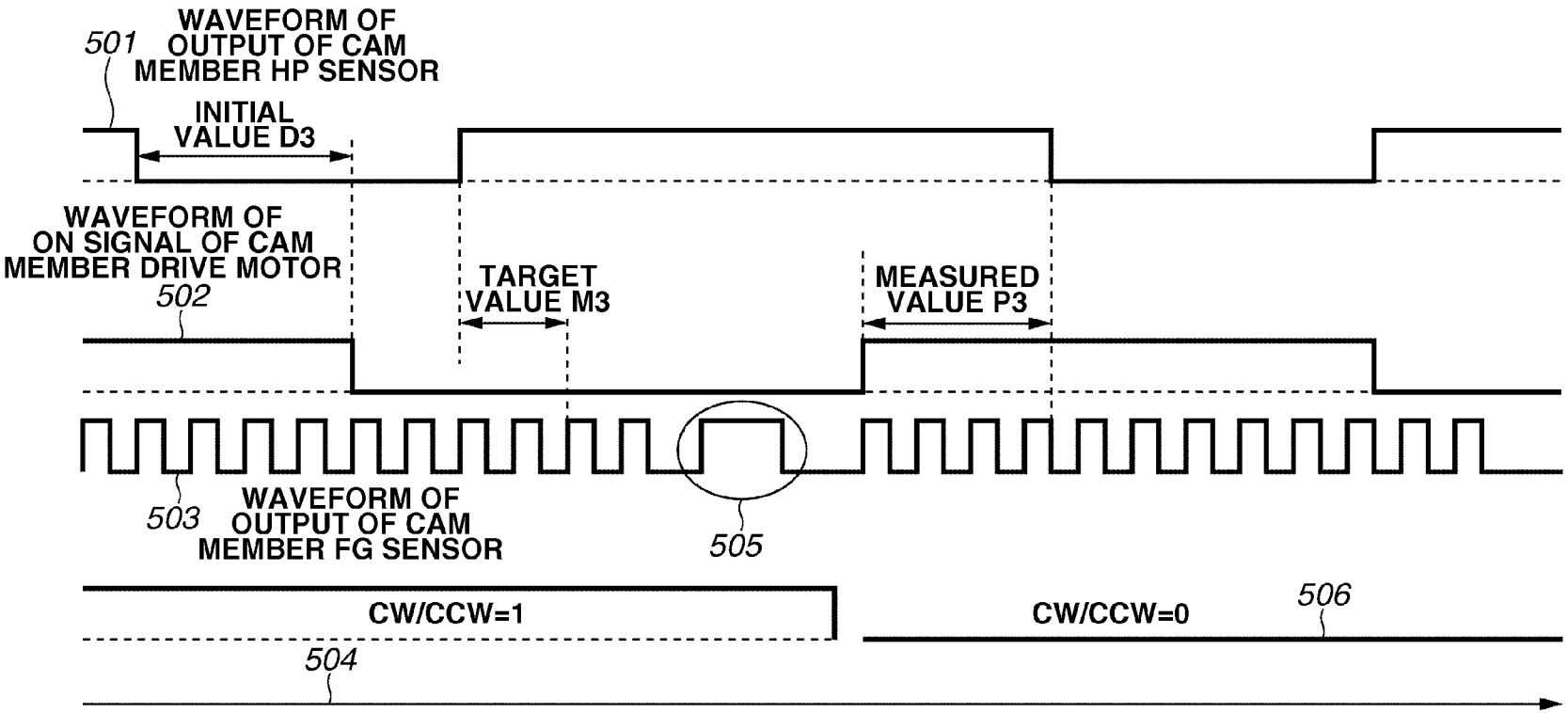
FIG. 15 is a timing chart of an operation at the time when a cam member can be stopped in a stop region during an operation for braking timing adjustment.

FIG. 15 is a timing chart when the cam member 72 could be stopped in the stop region during the braking timing adjustment. A signal 501 is the waveform of the output of the cam member HP sensor 56, and an H level indicates that the cam member 72 is in the stop region. In this example, the driving of the cam member drive motor 92 is started from a state where the cam member HP sensor 56 detects the flag 101, and the cam member HP sensor 56 then detects the flag 102 (the second H level of the signal 501). A signal 502 is the waveform of the ON signal of the cam member drive motor 92, and an H level indicates that the cam member drive motor 92 is driven. A signal 503 is the waveform of the output of the cam member FG sensor 59. A horizontal axis 504 indicates a time elapsing direction. A waveform 505 is the waveform of a portion where the output signal of the cam member FG sensor 59 is turned on or off due to the vibration during the stop of the cam member 72. When pulses in this portion are counted, a stop position may be erroneously detected. A signal 506 is a signal (CW/CCW) representing the rotational direction of the cam member drive motor 92, and an H level (CW/CCW=1) indicates a normal rotation direction.

In order to rotate the cam member drive motor 92 in a reverse direction after stopping the cam member drive motor 92, the CPU 111 then confirms the setting of the rotational direction, i.e., determines whether CW/CCW=1 in step S118. If CW/CCW=1 (YES in step S118), then in step S120, the CPU 111 sets CW/CCW to zero, to start the cam member drive motor 92. On the other hand, if CW/CCW=0 (NO in step S118), then in step S119, the CPU 111 sets CW/CCW to one, to start the cam member drive motor 92.

In step S121, the CPU 111 then subjects the motor ON signal to PWM control such that the speed of the cam member drive motor 92 becomes the target speed V1.

In step S122, the CPU 111 then starts to count the pulses output from the cam member FG sensor 59. In steps S123 and S124, the CPU 111 counts the number of pulses P3 from the cam member FG sensor 59 in a period of time elapsed since the start of the cam member drive motor 92 until the cam member HP sensor 56 is turned off (the second OFF in FIG. 15). In this case, the CPU 111 detects that the cam member HP sensor 56 has reached the leading edge of the flag 102, i.e., the end of the target stop region. The foregoing processing in steps S119 to S124 corresponds to second driving processing.

In step S125, the CPU 111 calculates braking timing B3 in a three-hole region from an equation 400:

$$B3=D3+M3-P3 \quad 400$$

D3: An initial value of braking timing in a three-hole region

M3: A target count value for stopping the cam member 72 in a stop region (corresponding to a movement distance in a period of time elapsed since the cam member HP sensor 56 was turned on until the cam member 72 is stopped)

P3: A count value of pulses in a period of time elapsed until the cam member 72 reaches a stop position (a position where the cam member HP sensor 56 is turned off)

In FIG. 15, a position from the rise of a second H level section of the signal 501 spaced by the target value M3 is the center of the stop region.

In step S126, the CPU 111 then determines whether the cam member HP sensor 56 is turned on. If the cam member HP sensor 56 is turned on (YES in step S128), the CPU 111 stops the cam member drive motor 92, to terminate the processing. The foregoing processing in steps S119 to S124 corresponds to second driving processing.

As illustrated in FIG. 15, the CPU 111 counts the pulses from the cam member FG sensor 59 in the period of time elapsed from the start of the cam member drive motor 92 until the cam member HP sensor 56 is turned off, to measure the stop position of the cam member 72. As a result, the generated pulses are prevented from being erroneously counted due to the vibration during the stop of the cam member drive motor 92, as indicated by the waveform 505 in FIG. 15. In FIG. 15, the reason why the cam member drive motor 92 is rotated in a reverse direction after being stopped once is that if the cam member drive motor 92 is driven in the same rotational direction even after the stop in a state where the cam member 72 is stopped in the stop region A or G, the cam member HP sensor 56 cannot be turned off, so that the stop position of the cam member cannot be measured.

If the cam member HP sensor 56 is not turned on (NO in step S115), then in step S138, the CPU 111 determines whether the timer counter T3 has reached 200 ms. If the cam member 72 cannot reach the stop region even if the timer counter T3 has reached 200 ms (YES in step S138), then in step S139, the CPU 111 determines a rotational direction in the previous operation of the cam member drive motor 92. In steps S140 and S141, the CPU 111 starts the cam member drive motor 92 again without changing the rotational direction from the rotational direction in the previous operation. In other words, the movement direction of the cam member 72 remains the same as the movement direction before the stop.

Figure 16:
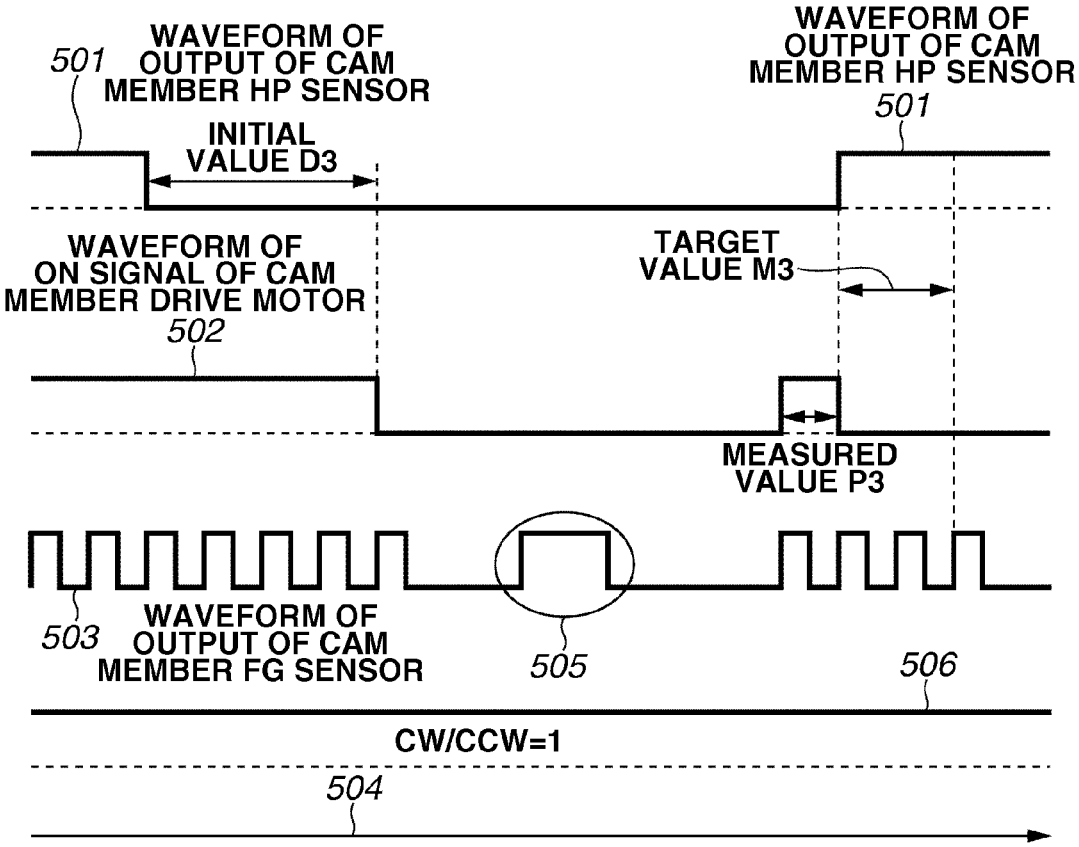
FIG. 16 is a timing chart of an operation at the time when a cam member cannot be stopped in a stop region during an operation for braking timing adjustment.

FIG. 16 is a timing chart when the cam member 72 cannot be stopped in the stop region during the braking timing adjustment. In this example, the cam member drive motor 92 rotates in a state where the cam member HP sensor 56 detects the flag 101, and the cam member HP sensor 56 detects the flag 102 (the second H level of a signal 501). In this example, a signal 503 is also turned on or off due to the vibration during the stop of the cam member 72, as indicated by a waveform 505. The rotational direction at the time when the cam member drive motor 92 is driven again does not change, as indicated by a signal 506.

In step S142, the CPU 111 then subjects the motor ON signal to PWM control such that the speed of the cam member drive motor 92 becomes the target speed V1. The target speed V1 is lower than the target speed V2, and is a speed at which the cam member 72 can be stopped in the stop region even if a brake is applied to the cam member drive motor 92 after the cam member HP sensor 56 is turned on.

In step S143, the CPU 111 starts to count the pulses from the cam member FG sensor 59. In steps S144 and S145, the CPU 111 counts the number of pulses P3 from the cam member FG sensor 59 in a period of time elapsed from the start of the cam member drive motor 92 until the cam member HP sensor 56 is turned on. The CPU 111 detects that the cam member HP sensor 56 has reached the leading edge of the flag 102, i.e., the end of the target stop region. The foregoing processing in step S140 to S145 corresponds to second driving processing. Thus counting the number of pulses from the start of the cam member drive motor 92 prevents the pulses from being erroneously counted due to the vibration during the stop of the cam member drive motor 92.

In step S146, the CPU 111 calculates braking timing B3 in a three-hole region from an equation 401:

$$B3=D3+M3+P3 \quad 401$$

where the definitions of D3, M3, and P3 are the same as those in the equation 400.

In FIG. 16, a position from the rise of a second H level section of the signal 501 spaced by the target value M3 is the center of the stop region.

In step S128, the CPU 111 stops the cam member drive motor 92, to terminate the processing.

As illustrated in FIG. 16, the CPU 111 measures a stop position of the cam member 72 by the count value of the pulses P3 from the cam member FG sensor 59 in the period of time elapsed from the start of the cam member drive motor 92 until the cam member HP sensor 56 is turned on. As a result, the generated pulses are prevented from being erroneously counted due to the vibration during the stop of the cam member drive motor 92, as indicated by the waveform 505 in FIG. 16.

If the cam member HP sensor 56 is turned off (NO in step S117), the cam member 72 passes through the stop region D and moves to the punching region again when the cam member drive motor 92 is stopped. In such a case, in step S129, the CPU 111 determines a rotational direction in the previous operation of the cam member drive motor 92. In steps S130 and S131, the CPU 111 starts the cam member drive motor 92 again in a rotational direction reverse to the rotational direction in the previous operation.

Figure 17:
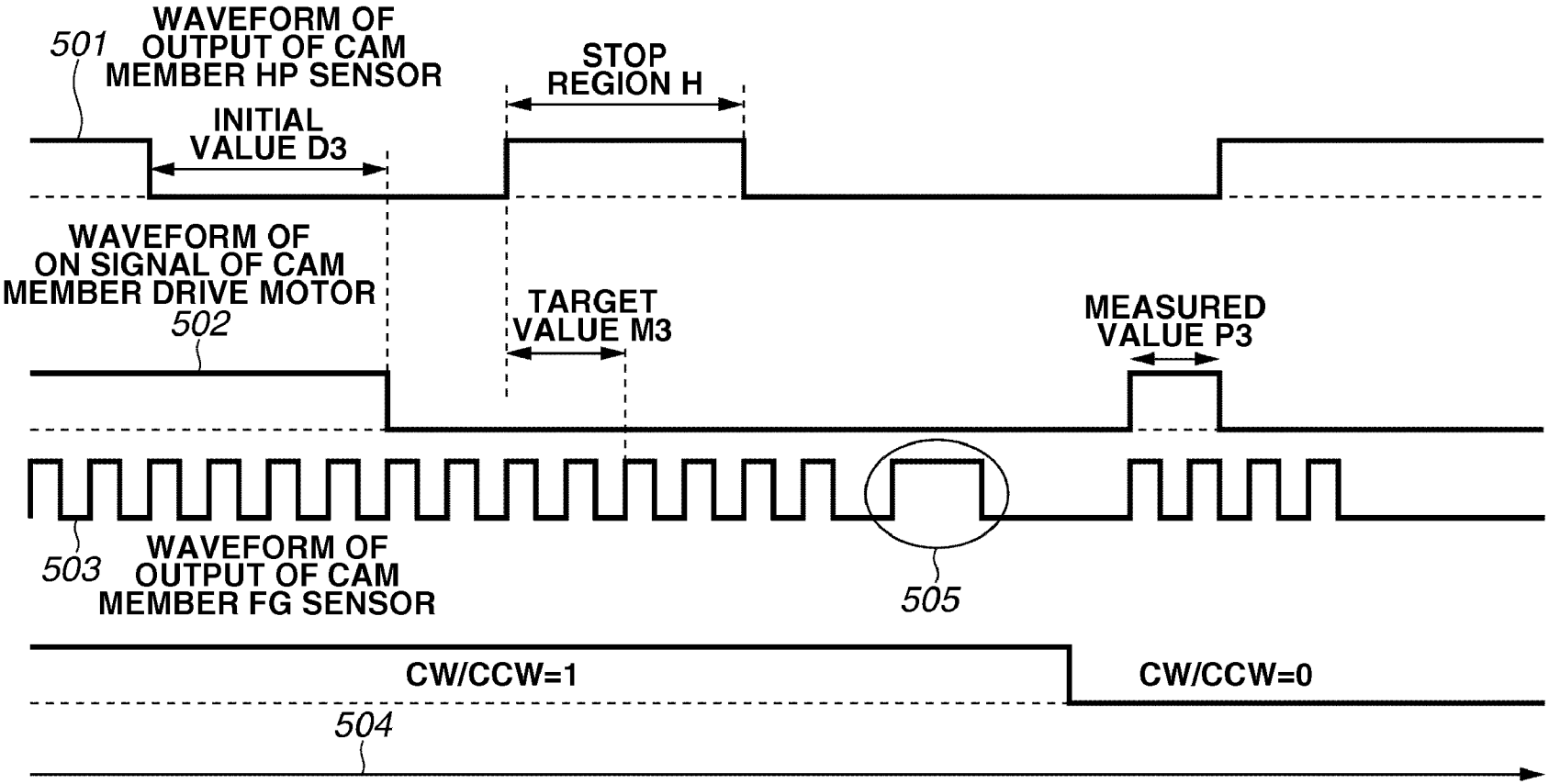
FIG. 17 is a timing chart of an operation at the time when a cam member has passed through a stop region during an operation for braking timing adjustment.

FIG. 17 is a timing chart when the cam member 72 has passed through the stop region during the braking timing adjustment. In this example, the cam member drive motor 92 is driven from a state where the cam member HP sensor 56 detects the flag 101, and the cam member HP sensor 56 then detects the flag 102 (the second H level of a signal 501). Thereafter, the cam member HP sensor 56 further detects the flag 102 from the opposite direction (the third H level of the signal 501). Also in this example, a signal 503 is turned on or off due to the vibration during the stop of the cam member 72, as indicated by a waveform 505.

In step S132, the CPU 111 subjects the motor ON signal to PWM control such that the speed of the cam member drive motor 92 becomes the target speed V1. In step S133, the CPU 111 then starts to count the pulses from the cam member FG sensor 59. In steps S134 and S135, the CPU 111 counts the number of pulses P3 from the cam member FG sensor 59 in a period of time elapsed from the start of the cam member drive motor 92 until the cam member HP sensor 56 is turned on. The CPU 111 detects that the cam member HP sensor 56 has reached a trailing edge of the flag 102, i.e., the end of the target stop region. The foregoing processing in steps S130 to S135 corresponds to second driving processing. Thus, the stop position of the cam member 72 is measured by the count value of the pulses P3 from the cam member FG sensor 59 in the period of time elapsed from the start of the cam member drive motor 92 until the cam member HP sensor 56 is turned on. Accordingly, the pulses are prevented from being erroneously counted due to the vibration during the stop of the cam member drive motor 92.

In step S136, the CPU 111 calculates braking timing B3 in a three-hole region from an equation 402:

$$B3=D3+M3-(P3+H) \quad 402$$

where the definitions of D3, M3, and P3 are the same as those in the equation 400. On the other hand, H denotes the number of pulses required for the cam member 72 to pass through the stop region D.

In FIG. 17, a position from the rise of a second H level section of the signal 501 spaced by the target value M3 is the center of the stop region.

In step S128, the CPU 111 stops the cam member drive motor 92, to terminate the processing.

As illustrated in FIG. 17, the CPU 111 measures the stop position of the cam member 72 by the count value of the pulses P3 from the cam member FG sensor 59 in the period of time elapsed from the start of the cam member drive motor 92 until the cam member HP sensor 56 is turned on. As a result, the generated pulses are prevented from being erroneously counted due to the vibration during the stop of the cam member drive motor 92, as indicated by the waveform 505 in FIG. 17.

The braking timing adjustment in the two-hole region is performed in the same method as that in the three-hole region.

In any of the cases illustrated in FIGS. 15, 16, and 17, the stop position of the cam member 72 after completion of the braking timing adjustment is a position where the cam member HP sensor 56 is turned on. Therefore, the CPU 111 grasps the position of the cam member 72.

According to the present exemplary embodiment, the punching apparatus 50 measures an amount of shift in the stop position from the center of the flag 102 representing a stop region when adjusting the braking timing of the cam member drive motor 92. This enables the punching apparatus 50 to stop the cam member 72 within the stop region even if there occurs a variation in the stop of the driving of the cam member drive motor 92 when punching the holes in the sheet P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-254002 filed Sep. 30, 2008, which is hereby incorporated by reference herein in its entirety.

What is claimed is:

1. A punching apparatus comprising:

a punch configured to punch holes in a sheet;

a cam member configured to reciprocally move the punch in a punching direction;

a motor configured to move the cam member;

a pulse generator configured to generate pulses that are synchronized with the driving of the motor; and a control unit configured to perform a stopping operation of the cam member moved by the driving of the motor upon counting the pulses of a predetermined number generated by the pulse generator after the cam member passes through a reference position, wherein the control unit drives the motor again after the cam member is stopped by performing the stopping operation and counts the pulses generated by the pulse generator after the motor is driven again until the cam member reaches a predetermined position, and wherein the control unit determines the predetermined number of the pulses according to a counted number of pulses after the motor is driven again until the cam member reaches the predetermined position.

2. The punching apparatus according to claim 1, further comprising:

a position detection unit configured to detect the cam member at the predetermined position, wherein the control unit determines, based on a detection result of the position detection unit, whether the cam member has reached the predetermined position as a result of performing the stopping operation.

3. The punching apparatus according to claim 2, wherein, in a case where the control unit determines that the cam member has not reached the predetermined position by performing the stopping operation, the control unit drives the motor again so that the cam member reaches the predetermined position and corrects the predetermined number of pulses based on a number of pulses generated by the pulse generator until the cam member reaches the predetermined position.

4. The punching apparatus according to claim 3, wherein the control unit drives the motor again at a driving speed slower than a driving speed at which the control unit starts the stopping operation.

5. The punching apparatus according to claim 2, wherein, in a case where the control unit determines that the cam member has passed the predetermined position by performing the stopping operation, the control unit drives the motor again so that the cam member moves back to the predetermined position and corrects the predetermined number of pulses based on a number of pulses generated by the pulse generator until the cam member moves back to the predetermined position.

6. The punching apparatus according to claim 5, wherein the control unit drives the motor again at a driving speed slower than a driving speed at which the control unit starts the stopping operation.

7. The punching apparatus according to claim 2, wherein, in a case where the control unit determines that the cam member is stopped at the predetermined position by performing the stopping operation, the control unit drives the motor again in a reverse direction so that the cam member passes the predetermined position and corrects the predetermined number of pulses based on a number of pulses generated by the pulse generator until the cam member passes the predetermined position.

8. The punching apparatus according to claim 7, wherein the control unit drives the motor again at a driving speed slower than a driving speed at which the control unit starts the stopping operation.

* * * * *